US011506430B2

(12) United States Patent
Lingrey et al.

(10) Patent No.: US 11,506,430 B2
(45) Date of Patent: Nov. 22, 2022

(54) AIR CONDITIONING SYSTEM WITH CAPACITY CONTROL AND CONTROLLED HOT WATER GENERATION

(71) Applicant: Climate Master, Inc., Oklahoma City, OK (US)

(72) Inventors: David J. Lingrey, Yukon, OK (US); Michael S. Privett, Tuttle, OK (US); Reem S. Merchant, Oklahoma City, OK (US); Michael F. Taras, Oklahoma City, OK (US)

(73) Assignee: Climate Master, Inc., Oklahoma City, OK (US)

( * ) Notice: Subject to any disclaimer, the term of this patent is extended or adjusted under 35 U.S.C. 154(b) by 143 days.

(21) Appl. No.: 16/897,252

(22) Filed: Jun. 9, 2020

(65) Prior Publication Data

US 2021/0018234 A1 Jan. 21, 2021

Related U.S. Application Data

(60) Provisional application No. 62/874,310, filed on Jul. 15, 2019.

(51) Int. Cl.
*F25B 41/26* (2021.01)
*F25B 13/00* (2006.01)

(52) U.S. Cl.
CPC ..... *F25B 41/26* (2021.01); *F25B 13/00* (2013.01)

(58) Field of Classification Search
CPC ..... F25B 13/00; F25B 41/26
See application file for complete search history.

(56) References Cited

U.S. PATENT DOCUMENTS 3,460,353 A 8/1969 Ogata et al.
3,916,638 A 11/1975 Schmidt
(Continued)

FOREIGN PATENT DOCUMENTS

CA 1178268 11/1984
CN 1987397 A 6/2007
(Continued)

OTHER PUBLICATIONS

"134-XS and 134-S Series Compressors ECOnomizer (EA-12-03-E)," 134-XS and 134-S series—Application and Maintenance Manual, Technical report EA1203E, RefComp Refrigerant Compressors, undated but believed to be publicly available at least as early as Mar. 2014 (4 pages).

(Continued)

*Primary Examiner* — Henry T Crenshaw
(74) *Attorney, Agent, or Firm* — Neal, Gerber & Eisenberg LLP; Thomas E. Williams

(57) ABSTRACT

An HVAC system is disclosed, comprising: (a) a compressor, (b) a source heat exchanger for exchanging heat with a source fluid, (c) a first load heat exchanger operable for heating/cooling air in a space, (d) a second load heat exchanger for heating water, (e) first and second reversing valves, (f) first and second 3-way valves, (f) a bi-directional electronic expansion valve, (g) a first bi-directional valve, and (h) a second bi-directional valve to modulate exchange of heat in the first load heat exchanger when operating as an evaporator and to control flashing of the refrigerant entering the source heat exchanger when operating as an evaporator, (h) a source pump for circulating the source fluid through the first load heat exchanger, (i) a water pump for circulating water through the second load heat exchanger, and (j) a controller to control operation of the foregoing.

19 Claims, 19 Drawing Sheets

(56) References Cited

U.S. PATENT DOCUMENTS 3,938,352 A 2/1976 Schmidt
4,072,187 A 2/1978 Lodge
4,173,865 A 11/1979 Sawyer
4,179,894 A 12/1979 Hughes
4,299,098 A 11/1981 Derosier
4,399,664 A 8/1983 Derosier
4,441,901 A 4/1984 Endoh
4,493,193 A 1/1985 Fisher
4,528,822 A 7/1985 Glamm
4,538,418 A 9/1985 Lawrence et al.
4,575,001 A 3/1986 Oskarsson et al.
4,592,206 A 6/1986 Yamazaki et al.
4,598,557 A 7/1986 Robinson et al.
4,645,908 A 2/1987 Jones
4,646,538 A 3/1987 Blackshaw et al.
4,685,307 A 8/1987 Jones
4,693,089 A 9/1987 Bourne et al.
4,698,978 A 10/1987 Jones
4,727,727 A 3/1988 Reedy
4,766,734 A 8/1988 Dudley
4,776,180 A 10/1988 Patton et al.
4,796,437 A 1/1989 James
4,798,059 A 1/1989 Morita
4,799,363 A 1/1989 Nakamura
4,835,976 A 6/1989 Torrence
4,856,578 A 8/1989 McCahill
4,893,476 A 1/1990 Bos et al.
4,909,041 A 3/1990 Jones
4,920,757 A 5/1990 Gazes et al.
4,924,681 A 5/1990 De Vit et al.
4,938,032 A 7/1990 Mudford
5,038,580 A 8/1991 Hart
5,044,425 A 9/1991 Tatsumi et al.
5,081,848 A 1/1992 Rawlings et al.
5,088,296 A 2/1992 Hamaoka
5,099,651 A 3/1992 Fischer
5,105,629 A 4/1992 Parris et al.
5,136,855 A 8/1992 Lenarduzzi
5,172,564 A 12/1992 Reedy
5,187,944 A 2/1993 Jarosch
5,224,357 A 7/1993 Galiyano et al.
5,269,153 A 12/1993 Cawley
5,305,822 A 4/1994 Kogetsu et al.
5,309,732 A 5/1994 Sami
5,323,844 A 6/1994 Sumitani et al.
5,339,890 A 8/1994 Rawlings
5,355,688 A 10/1994 Rafalovich et al.
5,372,016 A 12/1994 Rawlings
5,438,846 A 8/1995 Datta
5,461,876 A 10/1995 Dressier
5,465,588 A 11/1995 McCahill et al.
5,477,914 A 12/1995 Rawlings
5,497,629 A 3/1996 Rafalovich et al.
5,507,337 A 4/1996 Rafalovich et al.
5,533,355 A 7/1996 Rawlings
5,564,282 A 10/1996 Kaye
5,613,372 A 3/1997 Beal et al.
5,619,864 A 4/1997 Reedy
5,628,200 A 5/1997 Pendergrass
5,651,265 A 7/1997 Grenier
5,669,224 A 9/1997 Lenarduzzi
5,689,966 A 11/1997 Zess et al.
5,729,985 A 3/1998 Yoshihara et al.
5,758,514 A 6/1998 Genung et al.
5,802,864 A 9/1998 Yarbrough et al.
5,927,088 A 7/1999 Shaw
6,032,472 A 3/2000 Heinrichs et al.
6,070,423 A 6/2000 Hebert
6,082,125 A 7/2000 Savtchenko
6,123,147 A 9/2000 Pittman
6,149,066 A 11/2000 Perry et al.
6,167,715 B1 1/2001 Hebert
6,212,892 B1 4/2001 Rafalovich
6,227,003 B1 5/2001 Smolinsky
6,253,564 B1 7/2001 Yarbrough et al.
6,347,527 B1 2/2002 Bailey et al.
6,385,983 B1 5/2002 Sakki et al.
6,418,745 B1 7/2002 Ratliff
6,434,960 B1 8/2002 Rousseau
6,474,087 B1 11/2002 Lifson
6,536,221 B2 3/2003 James
6,655,164 B2 12/2003 Rogstam
6,662,864 B2 12/2003 Burk et al.
6,668,572 B1 12/2003 Seo et al.
6,694,750 B1 2/2004 Lifson et al.
6,729,151 B1 5/2004 Thompson
6,751,972 B1 6/2004 Jungwirth
6,804,975 B2 10/2004 Park
6,817,205 B1 11/2004 Lifson et al.
6,826,921 B1 12/2004 Uselton
6,857,285 B2 2/2005 Hebert
6,892,553 B1 5/2005 Lifson et al.
6,915,656 B2 7/2005 Ratliff
6,931,879 B1 8/2005 Wiggs
6,938,438 B2 9/2005 Lifson et al.
6,941,770 B1 9/2005 Taras et al.
7,000,423 B2 2/2006 Lifson et al.
7,059,151 B2 6/2006 Taras et al.
7,114,349 B2 10/2006 Lifson et al.
7,150,160 B2 12/2006 Herbert
7,155,922 B2 1/2007 Harmon et al.
7,185,505 B2 3/2007 Kamimura
RE39,597 E 5/2007 Rousseau
7,210,303 B2 5/2007 Zhang et al.
7,228,707 B2 6/2007 Lifson et al.
7,234,311 B2 6/2007 Lifson et al.
7,254,955 B2 8/2007 Otake et al.
7,263,848 B2 9/2007 Bhatti
7,272,948 B2 9/2007 Taras et al.
7,275,385 B2 10/2007 Abel et al.
7,325,414 B2 2/2008 Taras et al.
7,454,919 B2 11/2008 Ookoshi et al.
7,484,374 B2 2/2009 Pham et al.
7,617,697 B2 11/2009 McCaughan
7,654,104 B2 2/2010 Groll et al.
7,716,943 B2 5/2010 Seefeldt
7,770,405 B1 8/2010 Dillon
7,823,404 B2 11/2010 Hanson
7,845,190 B2 12/2010 Pearson
7,854,137 B2 12/2010 Lifson et al.
7,856,834 B2 12/2010 Haley
7,913,501 B2 3/2011 Ellis et al.
7,937,960 B2 5/2011 Matsui
7,958,737 B2 6/2011 Lifson et al.
7,975,495 B2 7/2011 Voorhis et al.
7,975,506 B2 7/2011 James et al.
7,997,092 B2 8/2011 Lifson et al.
8,037,713 B2 10/2011 Haley et al.
8,074,459 B2 12/2011 Murakami et al.
8,079,228 B2 12/2011 Lifson et al.
8,079,229 B2 12/2011 Lifson et al.
8,082,751 B2 12/2011 Wiggs
8,136,364 B2 3/2012 Lifson et al.
8,191,376 B2 6/2012 Fox et al.
8,220,531 B2 7/2012 Murakami et al.
8,286,438 B2 10/2012 McCahill
8,418,482 B2 4/2013 Bush et al.
8,418,486 B2 4/2013 Taras et al.
8,424,326 B2 4/2013 Mitra et al.
8,459,052 B2 6/2013 Bush et al.
8,528,359 B2 9/2013 Lifson et al.
8,561,425 B2 10/2013 Mitra et al.
8,650,893 B2 2/2014 Hanson
8,733,429 B2 5/2014 Harrison et al.
8,756,943 B2 6/2014 Chen et al.
8,769,982 B2 7/2014 Ignatiev et al.
8,984,903 B2 3/2015 Itoh et al.
9,052,125 B1 6/2015 Dostal
9,562,700 B2 2/2017 Watanabe
10,072,856 B1 9/2018 Akin et al.
10,118,462 B2 11/2018 Kohigashi et al.
10,119,738 B2 11/2018 Hammond et al.
10,345,004 B1 7/2019 Hern et al.
10,753,661 B2 8/2020 Hammond et al.

(56) References Cited

U.S. PATENT DOCUMENTS

| | | | | |
|---|---|---|---|---|
| 10,866,002 | B2 | 12/2020 | Taras et al. | |
| 10,871,314 | B2 | 12/2020 | Taras et al. | |
| 10,935,260 | B2 * | 3/2021 | Taras | F25B 40/02 |
| 2003/0061822 | A1 | 4/2003 | Rafalovich | |
| 2003/0221436 | A1 | 12/2003 | Xu | |
| 2003/0221445 | A1 | 12/2003 | Smolinsky | |
| 2006/0010908 | A1 | 1/2006 | Taras et al. | |
| 2006/0218949 | A1 | 10/2006 | Ellis et al. | |
| 2006/0225445 | A1 | 10/2006 | Lifson et al. | |
| 2007/0074536 | A1 | 4/2007 | Bai | |
| 2007/0289319 | A1 | 12/2007 | Kim et al. | |
| 2007/0295477 | A1 | 12/2007 | Mueller et al. | |
| 2008/0016895 | A1 | 1/2008 | Kim et al. | |
| 2008/0041072 | A1 | 2/2008 | Seefeldt | |
| 2008/0173034 | A1 | 7/2008 | Shaw | |
| 2008/0196418 | A1 | 8/2008 | Lifson et al. | |
| 2008/0197206 | A1 | 8/2008 | Murakami et al. | |
| 2008/0209930 | A1 | 9/2008 | Taras et al. | |
| 2008/0256975 | A1 | 10/2008 | Lifson et al. | |
| 2008/0282718 | A1 | 11/2008 | Beagle | |
| 2008/0296396 | A1 | 12/2008 | Corroy et al. | |
| 2008/0302113 | A1 | 12/2008 | Yin et al. | |
| 2008/0302118 | A1 | 12/2008 | Chen et al. | |
| 2008/0302129 | A1 | 12/2008 | Mosemann et al. | |
| 2008/0307813 | A1 | 12/2008 | Lifson et al. | |
| 2009/0000611 | A1 | 1/2009 | Kaiser | |
| 2009/0107656 | A1 | 4/2009 | Marois | |
| 2009/0208331 | A1 | 8/2009 | Haley et al. | |
| 2009/0294097 | A1 | 12/2009 | Rini et al. | |
| 2009/0314014 | A1 | 12/2009 | Ericsson | |
| 2010/0005821 | A1 | 1/2010 | McCahill | |
| 2010/0005831 | A1 | 1/2010 | Vaisman et al. | |
| 2010/0024470 | A1 | 2/2010 | Lifson et al. | |
| 2010/0058781 | A1 | 3/2010 | Lifson et al. | |
| 2010/0064710 | A1 | 3/2010 | Slaughter | |
| 2010/0064722 | A1 | 3/2010 | Taras | |
| 2010/0077788 | A1 | 4/2010 | Lewis | |
| 2010/0114384 | A1 | 5/2010 | Maxwell | |
| 2010/0132399 | A1 | 6/2010 | Mitra et al. | |
| 2010/0199715 | A1 | 8/2010 | Lifson et al. | |
| 2010/0251750 | A1 | 10/2010 | Lifson et al. | |
| 2010/0281894 | A1 | 11/2010 | Huff | |
| 2010/0287969 | A1 | 11/2010 | Ueda et al. | |
| 2010/0326100 | A1 | 12/2010 | Taras et al. | |
| 2011/0023515 | A1 | 2/2011 | Kopko et al. | |
| 2011/0036119 | A1 | 2/2011 | Fujimoto et al. | |
| 2011/0041523 | A1 | 2/2011 | Taras et al. | |
| 2011/0061413 | A1 | 3/2011 | Setoguchi | |
| 2011/0079032 | A1 | 4/2011 | Taras et al. | |
| 2011/0088426 | A1 | 4/2011 | Lochtefeld | |
| 2011/0094248 | A1 | 4/2011 | Taras et al. | |
| 2011/0094259 | A1 | 4/2011 | Lifson et al. | |
| 2011/0132007 | A1 | 6/2011 | Weyna et al. | |
| 2011/0174014 | A1 | 7/2011 | Scarcella et al. | |
| 2011/0203299 | A1 | 8/2011 | Jing et al. | |
| 2011/0209490 | A1 | 9/2011 | Mijanovic et al. | |
| 2011/0259025 | A1 * | 10/2011 | Noh | F24D 3/18 62/160 |
| 2011/0289950 | A1 | 12/2011 | Kim et al. | |
| 2011/0289952 | A1 | 12/2011 | Kim et al. | |
| 2012/0011866 | A1 | 1/2012 | Scarcella et al. | |
| 2012/0067965 | A1 | 3/2012 | Rajasekaran et al. | |
| 2012/0103005 | A1 | 5/2012 | Kopko et al. | |
| 2012/0198867 | A1 | 8/2012 | Ng et al. | |
| 2012/0205077 | A1 | 8/2012 | Zinger et al. | |
| 2012/0247134 | A1 | 10/2012 | Gurin | |
| 2012/0291460 | A1 | 11/2012 | Aoyagi | |
| 2013/0014451 | A1 | 1/2013 | Russell et al. | |
| 2013/0031934 | A1 | 2/2013 | Huff et al. | |
| 2013/0098085 | A1 | 4/2013 | Judge et al. | |
| 2013/0104574 | A1 | 5/2013 | Dempsey et al. | |
| 2013/0160985 | A1 * | 6/2013 | Chen | F25B 13/00 165/201 |
| 2013/0180266 | A1 * | 7/2013 | Bois | F25B 13/00 62/324.6 |
| 2013/0269378 | A1 | 10/2013 | Wong | |
| 2013/0305756 | A1 | 11/2013 | Gomes et al. | |
| 2014/0013782 | A1 | 1/2014 | Kopko et al. | |
| 2014/0013788 | A1 | 1/2014 | Kopko et al. | |
| 2014/0033753 | A1 | 2/2014 | Lu et al. | |
| 2014/0033755 | A1 | 2/2014 | Wong | |
| 2014/0053585 | A1 | 2/2014 | Huff | |
| 2014/0060101 | A1 | 3/2014 | Styles et al. | |
| 2014/0123689 | A1 | 5/2014 | Ellis et al. | |
| 2014/0245770 | A1 | 9/2014 | Chen et al. | |
| 2014/0260392 | A1 | 9/2014 | Hawkins et al. | |
| 2015/0052937 | A1 | 2/2015 | Hung | |
| 2015/0059373 | A1 | 3/2015 | Maiello et al. | |
| 2015/0204586 | A1 | 7/2015 | Burg et al. | |
| 2015/0285539 | A1 | 10/2015 | Kopko | |
| 2017/0010029 | A9 | 1/2017 | Reytblat et al. | |
| 2017/0227250 | A1 | 8/2017 | Karamanos | |
| 2018/0010829 | A1 | 1/2018 | Taras et al. | |
| 2018/0128506 | A1 * | 5/2018 | Taras | F25B 30/02 |
| 2018/0313555 | A1 | 11/2018 | Henderson | |
| 2019/0032981 | A1 | 1/2019 | Hammond et al. | |
| 2019/0178509 | A1 | 6/2019 | Taras et al. | |
| 2020/0072510 | A1 | 3/2020 | Brown | |
| 2020/0378667 | A1 | 12/2020 | Hammond et al. | |
| 2021/0095872 | A1 | 4/2021 | Taras et al. | |
| 2021/0131709 | A1 | 5/2021 | Taras et al. | |
| 2021/0180807 | A1 | 6/2021 | Taras et al. | |

FOREIGN PATENT DOCUMENTS

| | | | |
|---|---|---|---|
| CN | 201944952 | U | 8/2011 |
| CN | 102353126 | A | 2/2012 |
| CN | 203231582 | U | 10/2013 |
| CN | 103471275 | A | 12/2013 |
| CN | 203396155 | U | 1/2014 |
| CN | 203432025 | U | 2/2014 |
| EP | 134015 | | 3/1985 |
| EP | 1983275 | A1 | 10/2008 |
| JP | 2000046417 | | 2/2000 |
| JP | 2000274786 | | 10/2000 |
| JP | 2000314563 | | 11/2000 |
| JP | 2001248931 | | 9/2001 |
| KR | 100963221 | B1 | 6/2010 |
| WO | 9600370 | | 1/1996 |
| WO | 2001/90663 | | 11/2001 |
| WO | 2006/033782 | | 3/2006 |
| WO | 2008/045086 | | 4/2008 |
| WO | 2008/048252 | | 4/2008 |
| WO | 2010/005918 | | 1/2010 |
| WO | 2010/054498 | | 5/2010 |
| WO | 2010/104709 | | 9/2010 |
| WO | 2013/142760 | | 9/2013 |
| WO | 2014/031559 | A1 | 2/2014 |
| WO | 2014/031708 | A1 | 2/2014 |

OTHER PUBLICATIONS

"Economized Vapor Injection (EVI) Compressors," Emerson Climate Technologies Application Engineering Bulletin AE4-1327 R2, Revised Sep. 2006 (9 pages).

"Enhanced Vapour Injection (EVI) for ZH KVE Scroll Compressors," Emerson Climate Technologies—Technical Information, C7.4. 3/1107-0512/E, May 2012 (10 pages).

"Heat Pump Mechanics" http://www.geo4va.vt.edu/A3/A3.htm#A3sec3c (Accessed Apr. 20, 2011) (19 pages).

"Heat pumps in residential and commercial buildings" http://www.heatpumpcentre.org/en/aboutheatpumps/heatpumpsinresidential/Sidor/default.aspx (Accessed Apr. 20, 2011) (2 pages).

B.P. Rasmussen et al., "Model-Driven System Identification of Transcritical Vapor Compression Systems," IEEE Transactions on Control Systems Technology, May 2005, pp. 444-451, vol. 13 (8 pages).

Ekaterina Vi Nogradova, "Economizers in Chiller Systems," Bachelor's Thesis, Mikkelin Ammattikorkeakoulu, Nov. 2012 (50 pages).

Haraldsson et al., "Measurement of Performance and Evaluation of a Heat Pump—with Scroll Compressor EVI and Economizer," Lunds Institute of Technology, 2006 (4 pages).

(56) References Cited

OTHER PUBLICATIONS

Honeywell, VFF1, VFF2, VFF3, VFF6 Resilient Seat Butterfly Valves with Flanged Connections Jan. 2013, p. 1, 1st col. last paragraph. (Year: 2013) (20 pages).
International Preliminary Report on Patentability issued in International Application No. PCT/US2013/033433 dated Sep. 23, 2014 (7 Pages).
International Search Report and Written Opinion issued in International Application No. PCT/US2013/033433 dated Aug. 9, 2013 (11 Pages).
John P. Elson et al., "Scroll Technology: An Overview of Past, Present and Future Developments," International Compressor Engineering Conference, 2008, Paper 1871 (9 pages).
Korean Intellectual Property Office, International Search Report in International Application No. PCT/US2009/049734 (dated Jan. 20, 2010) (2 pages).
Korean Intellectual Property Office, International Search Report in International Application No. PCT/US2010/026010 (dated Sep. 28, 2010) (2 pages).
Lund et al., "Geothermal (Ground-Source Heat Pumps—A World Overview," GHC Bulletin, Sep. 2004 (edited and updated version of the article from Renewal Energy World, (Jul.-Aug. 2003), vol. 6 No. 4) (10 pages).
Michael F. Taras, "Reheat Which Concept is Best," ASHRAE Journal: 35-40 (Dec. 2004) (7 pages).
Murphy et al., "Air-Source Integrated Heat Pump for Net-Zero-Energy Houses Technology Status Report," Oak Ridge National Laboratory, ORNL-TM-2007-112 (Jul. 2007) (93 pages).
Murphy et al., "Ground-Source Integrated Heat Pump for Net-Zero-Energy Houses Technology Status Report," *Oak Ridge National Laboratory*, ORNL-TM-2007-177 (Dec. 2007) (78 pages).
Third Party Submission dated Nov. 10, 2014 filed in U.S. Appl. No. 13/848,342 (13 Pages).
Tolga N. Aynur, "Variable Refrigerant Flow Systems: A Review, Energy and Buildings," Jan. 2010, pp. 1106-1112, vol. 42 (7 pages).
Wei Yang et al., "The Design Method of U-Bend Geothermal Heat Exchanger of DX-GCHP in Cooling Model," IEEE, 2011, pp. 3635-3637 (English Abstract) (3 pages).

* cited by examiner

AIR CONDITIONING SYSTEM WITH CAPACITY CONTROL AND CONTROLLED HOT WATER GENERATION

CROSS-REFERENCE TO RELATED APPLICATION

This application claims the benefit of U.S. Provisional Application No. 62/874,310, filed on Jul. 15, 2019, which is incorporated by reference herein in its entirety.

BACKGROUND

The instant disclosure relates generally to heating, ventilation, and air conditioning (HVAC) systems, including heat pump systems, as well as methods of operating such systems.

SUMMARY

Disclosed are various embodiments of a heating, ventilation, and air conditioning system for conditioning air in a space and optionally for heating water for domestic, commercial, or industrial process uses.

In one embodiment, an HVAC system for conditioning air in a space includes a refrigerant circuit that fluidly interconnects: (a) a compressor to circulate a refrigerant through the refrigerant circuit, the compressor having a discharge outlet port and an suction inlet port; (b) a source heat exchanger operable as either a condenser or an evaporator for exchanging heat with a source fluid; (c) a space heat exchanger operable as either a condenser or an evaporator for heating or cooling air in the space; (d) a desuperheater heat exchanger operable as a condenser for heating water; (e) a first reversing valve positioned downstream of the compressor to alternately direct the refrigerant from the discharge outlet port of the compressor to one of a second reversing valve, a first 3-way valve, and a second 3-way valve and to alternately return the refrigerant from one of the second reversing valve and the second 3-way valve to the suction inlet port of the compressor, wherein the first 3-way valve is configured to selectively direct the refrigerant to the desuperheater heat exchanger from one of the first and second reversing valves, and the second 3-way valve is configured to selectively direct the refrigerant to the first reversing valve and the space heat exchanger; (f) first and second expansion devices positioned between the source and space heat exchangers; (g) first and second expansion device bypass circuits configured to allow the refrigerant to bypass the first and second expansion devices, respectively, the first and second expansion device bypass circuits comprising first and second check valves, respectively, to control a direction of the refrigerant in the first and second expansion device bypass circuits; and (h) a first bi-directional valve positioned downstream of the second reversing valve to selectively convey the refrigerant to at least one of the first 3-way valve, the second 3-way valve, and a second bi-directional valve, wherein the second bi-directional valve modulates exchange of heat in the space heat exchanger when the space heat exchanger is operating as an evaporator and eliminates flashing of the refrigerant entering the source heat exchanger when the source heat exchanger is operating as an evaporator.

The compressor may be a variable capacity compressor. The HVAC system may include a liquid pump associated with the source heat exchanger and the liquid pump may be a variable capacity pump. The source heat exchanger may be a refrigerant-to-liquid heat exchanger configured to exchange heat between the refrigerant in the refrigerant circuit and the source fluid in a source loop. The space heat exchanger may be a refrigerant-to-air heat exchanger. The desuperheater heat exchanger may be a refrigerant-to-liquid heat exchanger configured to exchange heat between the refrigerant in the refrigerant circuit and water in a storage loop.

The HVAC system may include a fan driven by a variable speed motor, and the fan may be configured to flow air over a portion of the space heat exchanger. The first and second expansion devices may be fixed orifice devices, mechanical valves, or electronic valves. The HVAC system may include a storage tank for storing heated water. The HVAC system may include a variable speed water pump for circulating heated water in the storage loop and through the desuperheater heat exchanger and a variable speed source fluid pump for circulating the source fluid in the source loop and through the source heat exchanger.

The HVAC system may include a third bi-directional valve positioned upstream of the second reversing valve to temporarily divert the refrigerant away from the second reversing valve when switching the second reversing valve from one operating configuration to another, and a fourth bi-directional valve positioned downstream of the second reversing valve and upstream of the first bi-directional valve to divert partially condensed refrigerant from the desuperheater heat exchanger to one of the first and second expansion devices. The HVAC system may include a controller comprising a processor and memory on which one or more software programs are stored. The controller may be configured to control operation of the compressor, the first and second reversing valves, the first and second 3-way valves, the first and second expansion devices, the first and second bi-directional valves, a first variable speed pump for circulating water through the desuperheater heat exchanger, and a second variable speed pump for circulating the source fluid through the source heat exchanger.

To operate the HVAC system in a space cooling mode: (a) the first reversing valve diverts the refrigerant from the compressor to the second reversing valve and from the second 3-way valve to the compressor, (b) the second reversing valve diverts the refrigerant from the first reversing valve to the source heat exchanger configured as a condenser, (c) the first and second bi-directional valves are closed, (d) the first expansion device is closed and the refrigerant is diverted through the first check valve via the first expansion device bypass circuit, (e) the second expansion device is open and directs the refrigerant to the space heat exchanger configured as an evaporator, and the second 3-way valve diverts the refrigerant from the space heat exchanger to the first reversing valve.

To operate the HVAC system in a cooling mode with an active desuperheater: (a) the first reversing valve diverts the refrigerant from the compressor to the second reversing valve and from the second 3-way valve to the compressor, (b) the second reversing valve diverts the refrigerant from the first reversing valve to the first bi-directional valve and from the desuperheater heat exchanger to the source heat exchanger configured as a condenser, (c) the first bi-directional valve is open, (d) the second bi-directional valve is closed, (e) the first expansion device is closed and the refrigerant is diverted through the first check valve via the first expansion device bypass circuit, (f) the second expansion device is open and directs the refrigerant to the space heat exchanger configured as an evaporator, and (g) the second 3-way valve diverts the refrigerant from the space heat exchanger to the first reversing valve.

To operate the HVAC system in a cooling mode with an active desuperheater and with space heat exchanger tempering: (a) the first reversing valve diverts the refrigerant from the compressor to the second reversing valve and from the second 3-way valve to the compressor, (b) the second reversing valve diverts the refrigerant from the first reversing valve to the first bi-directional valve and from the desuperheater heat exchanger to the source heat exchanger configured as a condenser, (c) the first bi-directional valve and the second bi-directional valve are open and a first portion of the refrigerant from the first bi-directional valve is conveyed to the first 3-way valve and a second portion of the refrigerant is conveyed to the second bi-directional valve, wherein the first portion of the refrigerant is conveyed to the desuperheater heat exchanger and then to the source heat exchanger via the second reversing valve, (d) the first expansion device is closed and the first portion of the refrigerant is conveyed from the source heat exchanger through the first check valve via the first expansion device bypass circuit and to the second expansion device, (e) the second expansion device is open, and the first portion of the refrigerant from the second expansion device and the second portion of the refrigerant from the second bi-directional valve are mixed and conveyed to the space heat exchanger configured as an evaporator, and (f) the second 3-way valve diverts the refrigerant from the space heat exchanger to the first reversing valve.

To operate the HVAC system in a space heating mode: (a) the first reversing valve diverts the refrigerant from the compressor to the second 3-way valve and from the second reversing valve to the compressor, (b) the second reversing valve diverts the refrigerant from the source heat exchanger configured as an evaporator to the first reversing valve, (c) the second 3-way valve diverts the refrigerant to the space heat exchanger configured as a condenser, (d) the first and second bi-directional valves are closed, (e) the second expansion device is closed and the refrigerant is diverted through the second check valve via the second expansion device bypass circuit, (f) the first expansion device is open and directs the refrigerant to the source heat exchanger configured as an evaporator, and (g) the refrigerant leaving the source heat exchanger is directed to the second reversing valve.

To operate the HVAC system in a heating mode with an active desuperheater: (a) the first reversing valve diverts the refrigerant from the compressor to the first 3-way valve and from the second reversing valve to the compressor, (b) the first 3-way valve diverts the refrigerant from the first reversing valve to the desuperheater heat exchanger, and the refrigerant leaving the desuperheater heat exchanger is conveyed to the second reversing valve, (c) the second reversing valve diverts the refrigerant from the desuperheater heat exchanger to the first bi-directional valve and from the source heat exchanger to the first reversing valve, (d) the first bi-directional valve is open and the refrigerant from the first bi-directional valve is conveyed to the second 3-way valve, (e) the second 3-way valve diverts the refrigerant to the space heat exchanger configured as a condenser, (f) the second bi-directional valve is closed, (g) the second expansion device is closed and the refrigerant is conveyed through the second check valve via the second expansion device bypass circuit, (h) the first expansion device is open and directs the refrigerant to the source heat exchanger configured as an evaporator, and (i) the refrigerant leaving the source heat exchanger is directed to the second reversing valve.

To operate the HVAC system in a space heating mode with an active desuperheater and expansion device boost: (a) the first reversing valve diverts the refrigerant from the compressor to the first 3-way valve and from the second reversing valve to the compressor, (b) the first 3-way valve diverts the refrigerant from the first reversing valve to the desuperheater heat exchanger, and the refrigerant leaving the desuperheater heat exchanger is conveyed to the second reversing valve, (c) the second reversing valve diverts the refrigerant from the desuperheater heat exchanger to the first bi-directional valve and from the source heat exchanger to the first reversing valve, (d) the first bi-directional valve and the second bi-directional valve are open and a first portion of the refrigerant from the first bi-directional valve is conveyed to the second 3-way valve and a second portion of the refrigerant is conveyed to the second bi-directional valve, (e) the second 3-way valve diverts the first portion of the refrigerant to the space heat exchanger configured as a condenser, wherein the second portion of the refrigerant from the second bi-directional valve is mixed with the first portion of the refrigerant from the space heat exchanger configured as a condenser and conveyed through the second check valve via the second expansion device bypass circuit to the first expansion device, (f) the first expansion device is open and directs the refrigerant to the source heat exchanger configured as an evaporator, and (g) the refrigerant leaving the source heat exchanger is directed to the second reversing valve.

In another embodiment, an HVAC system for conditioning air in a space includes: (a) a compressor to circulate a refrigerant through a refrigerant circuit, the compressor having a discharge outlet port and an suction inlet port; (b) a source heat exchanger operable as either a condenser or an evaporator for exchanging heat with a source fluid; (c) a first load heat exchanger operable as either a condenser or an evaporator for heating or cooling air in the space; (d) a second load heat exchanger operable as a condenser for heating water; (e) a first reversing valve positioned downstream of the compressor to alternately direct the refrigerant from the discharge outlet port of the compressor to one of a second reversing valve, a first 3-way valve, and a second 3-way valve and to alternately return the refrigerant from one of the second reversing valve and the second 3-way valve to the suction inlet port of the compressor, wherein the first 3-way valve is configured to selectively direct the refrigerant to the second load heat exchanger from one of the first and second reversing valves, and the second 3-way valve is configured to selectively direct the refrigerant to the first reversing valve and the first load heat exchanger; (e) a bi-directional expansion valve positioned between the source and first load heat exchangers; (f) a first bi-directional valve positioned downstream of the second reversing valve to selectively convey the refrigerant to at least one of the first 3-way valve, the second 3-way valve, and a second bi-directional valve, wherein the second bi-directional valve modulates exchange of heat in the first load heat exchanger when the first load heat exchanger is operating as an evaporator and controls flashing of the refrigerant entering the source heat exchanger when the source heat exchanger is operating as an evaporator; and (g) a controller comprising a processor and memory on which one or more software programs are stored, the controller configured to control operation of the compressor, the first and second reversing valves, the first and second 3-way valves, the bi-directional expansion valve, the first and second bi-directional valves, a first variable speed pump for circulating water through the second load heat exchanger, and a second variable speed pump for circulating the source fluid through the source heat exchanger.

The compressor may be a variable capacity compressor. The HVAC system may include a liquid pump associated with the source heat exchanger and the pump may be a variable capacity pump. The source heat exchanger may be a refrigerant-to-liquid heat exchanger configured to exchange heat between the refrigerant in the refrigerant circuit and the source fluid in a source loop. The space heat exchanger may be a refrigerant-to-air heat exchanger. The desuperheater heat exchanger may be a refrigerant-to-liquid heat exchanger configured to exchange heat between the refrigerant in the refrigerant circuit and water in a storage loop.

The HVAC system may include a fan driven by a variable speed motor, and the fan may be configured to flow air over a portion of the space heat exchanger. The HVAC system may include a storage tank for storing heated water. The HVAC system may include a variable speed water pump for circulating heated water in the storage loop and through the desuperheater heat exchanger and a variable speed source fluid pump for circulating the source fluid in the source loop and through the source heat exchanger. The space heat exchanger may alternatively be a refrigerant-to-liquid heat exchanger for exchanging heat with a liquid for any use, including conditioning air in a space or for industrial purposes.

The HVAC system may include a third bi-directional valve positioned upstream of the second reversing valve to temporarily divert the refrigerant away from the second reversing valve when switching the second reversing valve from one operating configuration to another, and a fourth bi-directional valve positioned downstream of the second reversing valve and upstream of the first bi-directional valve to divert partially condensed refrigerant from the desuperheater heat exchanger to one of the first and second expansion devices.

The HVAC system may be operated in any one of a plurality of operating modes, including: (a) a space cooling mode, (b) a cooling mode with an active desuperheater, (c) a cooling mode with an active desuperheater and with space heat exchanger tempering, (d) a space heating mode, (e) a heating mode with an active desuperheater, (f) a heating mode with an active desuperheater and expansion valve boost.

DETAILED DESCRIPTION

Figure 1:
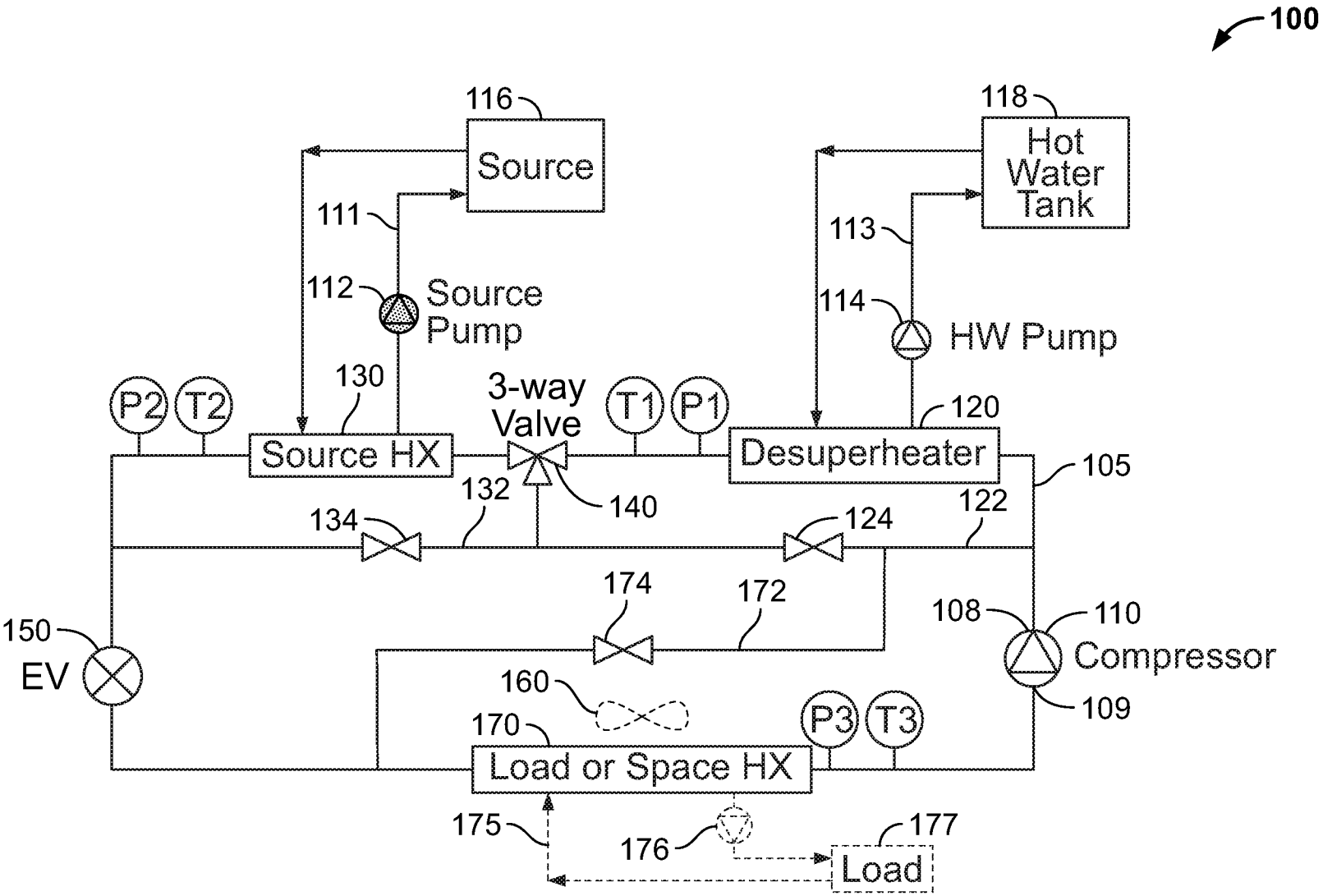
FIG. 1 is a schematic showing an embodiment of an HVAC system of the instant disclosure.

Although the figures and the instant disclosure describe one or more embodiments of a heat pump system, one of ordinary skill in the art would appreciate that the teachings of the instant disclosure would not be limited to these embodiments. It should be appreciated that any of the features of an embodiment discussed with reference to the figures herein may be combined with or substituted for features discussed in connection with other embodiments in this disclosure.

The instant disclosure provides improved and flexible HVAC operation to condition air in a space and optionally to heat water for domestic, commercial, or industrial process uses. The various embodiments disclosed herein take advantage of properties of the compressor's discharge hot gas flow through an auxiliary heat exchanger (e.g., desuperheater) coupled to a water flow stream to heat the water when hot water is demanded. The various embodiments disclosed herein offer the advantages of:

- Having a large capacity for hot water generation in comparison to the size of the system to allow for faster re-filling of a hot water reservoir and to maximize hot water recovery time at peak hot water demand.
- Improved operating efficiencies across a broad range of environmental conditions, where the system may be configured to maintain efficient control the throughout various operating conditions and part-load conditions. The various embodiments disclosed herein provide extremely high energy efficiency by controlling condensing temperatures to achieve peak system performance.
- Improved control of pressures along the refrigerant circuit to maintain consistent energy usage efficiency under part-load conditions.

By using a desuperheater heat exchanger acting as a condenser, the system optimizes space and improves heat exchange.

Improved evaporator frost and freeze prevention to avoid frosted coils and associated downtime or defrost requirements.

The embodiments of an HVAC system disclosed herein may provide operational flexibility via a modulating, pulse width modulating (PWM) or rapid cycle solenoid valve to divert at least a portion of the refrigerant from the refrigerant circuit to one or more bypass circuits to bypass, for example, an inactive heat exchanger or to modulate or temper heat exchange by a particular heat exchanger. Alternatively or additionally, an ON-OFF 3-way valve and a bypass valve may be replaced by the modulating, PWM or rapid cycle solenoid 3-way valve. A controller comprising a processor coupled to memory on which one or more software algorithms are stored may process and issue commands to open, partially open, or close any of the valves disclosed herein. Open or closed feedback loops may be employed to determine current and desired valve positions.

The embodiments of an HVAC system disclosed herein may employ variable speed or multi-speed hot water and/or source fluid pumps, fan and/or blower motor, and compressor to control operation of these components to provide the desired system performance.

Any of the expansion valves disclosed herein may be any type of expansion device, including a thermostatic expansion valve, and can be electronic, mechanical, electromechanical, or fixed orifice type. All of the embodiments described herein provide improved comfort level, system performance, and system reliability.

In one embodiment, a vapor compression circuit of an HVAC system capable of multiple operating modes to heat or cool a space and optionally to heat water includes a compressor, a desuperheater heat exchanger (or simply "desuperheater") operable as a condenser to heat water for domestic, commercial and/or industrial process purposes, a source heat exchanger operable as either a condenser or an evaporator, a space heat exchanger operable as either a condenser or an evaporator, a 3-way valve positioned between the desuperheater and the source heat exchanger, an expansion valve positioned between the source heat exchanger and the space heat exchanger, a plurality of bi-directional valves positioned along a plurality of bypass circuits, a plurality of temperature and pressure sensors positioned at various locations along the main refrigerant circuit and/or bypass circuits, and a controller configured to operate one or more of these components. This embodiment may include one or more reversing valves to reverse the flow of refrigerant to enable the HVAC system to operate in one or more space cooling and space heating operating modes, as in a heat pump. This embodiment may also include one or more diverters or diverter valves to modulate or temper the heat exchange by the space heat exchanger.

In one or more operating modes when the desuperheater is active (i.e., functioning as a heat exchanger), the desuperheater is positioned downstream of the compressor and upstream of the 3-way valve with respect to flow of refrigerant in the refrigerant circuit. In one or more operating modes when the source heat exchanger is active, the source heat exchanger is positioned downstream of the 3-way valve and upstream of the expansion valve with respect to flow of refrigerant in the refrigerant circuit. In one or more space cooling operating modes, the space heat exchanger is active and is positioned downstream of the expansion valve and upstream of the compressor. In one or more operating modes when the desuperheater is inactive, refrigerant flow bypasses the desuperheater and is routed from the compressor to the 3-way valve. In some embodiments, at least a portion of the refrigerant leaving the compressor may be diverted from the refrigerant being directed to the 3-way valve when the desuperheater is inactive or to the desuperheater when the desuperheater is active and direct that diverted portion of the refrigerant to the space heat exchanger to modulate or temper the heat exchange by the space heat exchanger. The relative positions of at least some of these components are swapped if a reversing valve is employed to reverse the direction of refrigerant to switch from a cooling mode to a heating mode and vice versa.

In another embodiment, a vapor compression circuit of an HVAC system capable of multiple operating modes to heat or cool a space and optionally to heat water includes a compressor, a pair of reversing valves, a pair of 3-way valves, a pair of expansion valves (one active and one inactive in any given operating mode), a desuperheater heat exchanger operable to heat water for domestic, commercial and/or industrial process purposes, a source heat exchanger operable as either a condenser or an evaporator, a space heat exchanger operable as either a condenser or an evaporator, a pair of check valves, a plurality of bi-directional valves, a plurality of temperature and pressure sensors positioned at various locations along the refrigerant circuit and/or bypass circuits, and a controller configured to operate one or more of these components.

Figure 2:
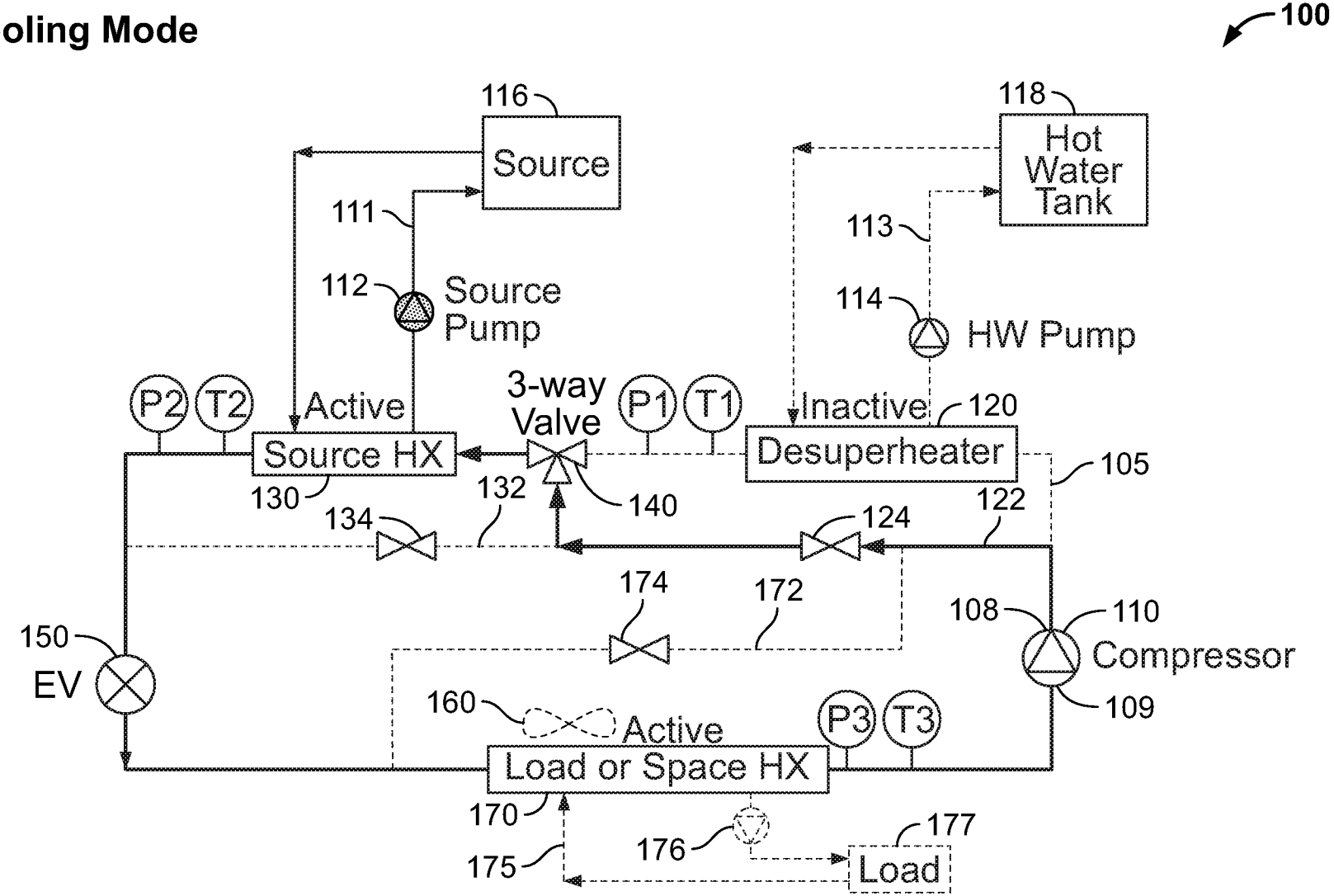
FIG. 2 is a schematic showing the HVAC system of FIG. 1 in a cooling mode.
Figure 3:
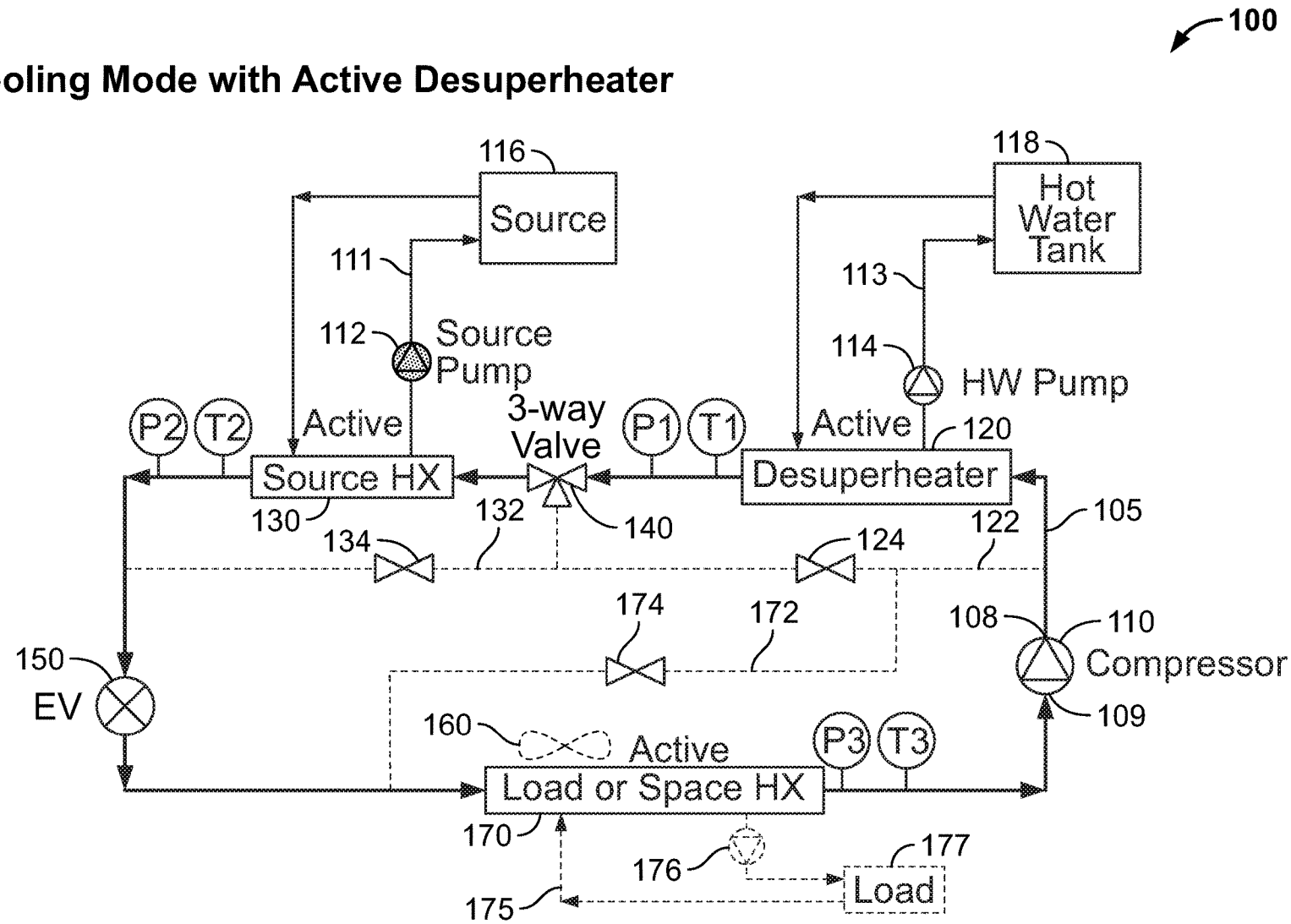
FIG. 3 is a schematic showing the HVAC system of FIG. 1 in a cooling mode with an active desuperheater.
Figure 4:
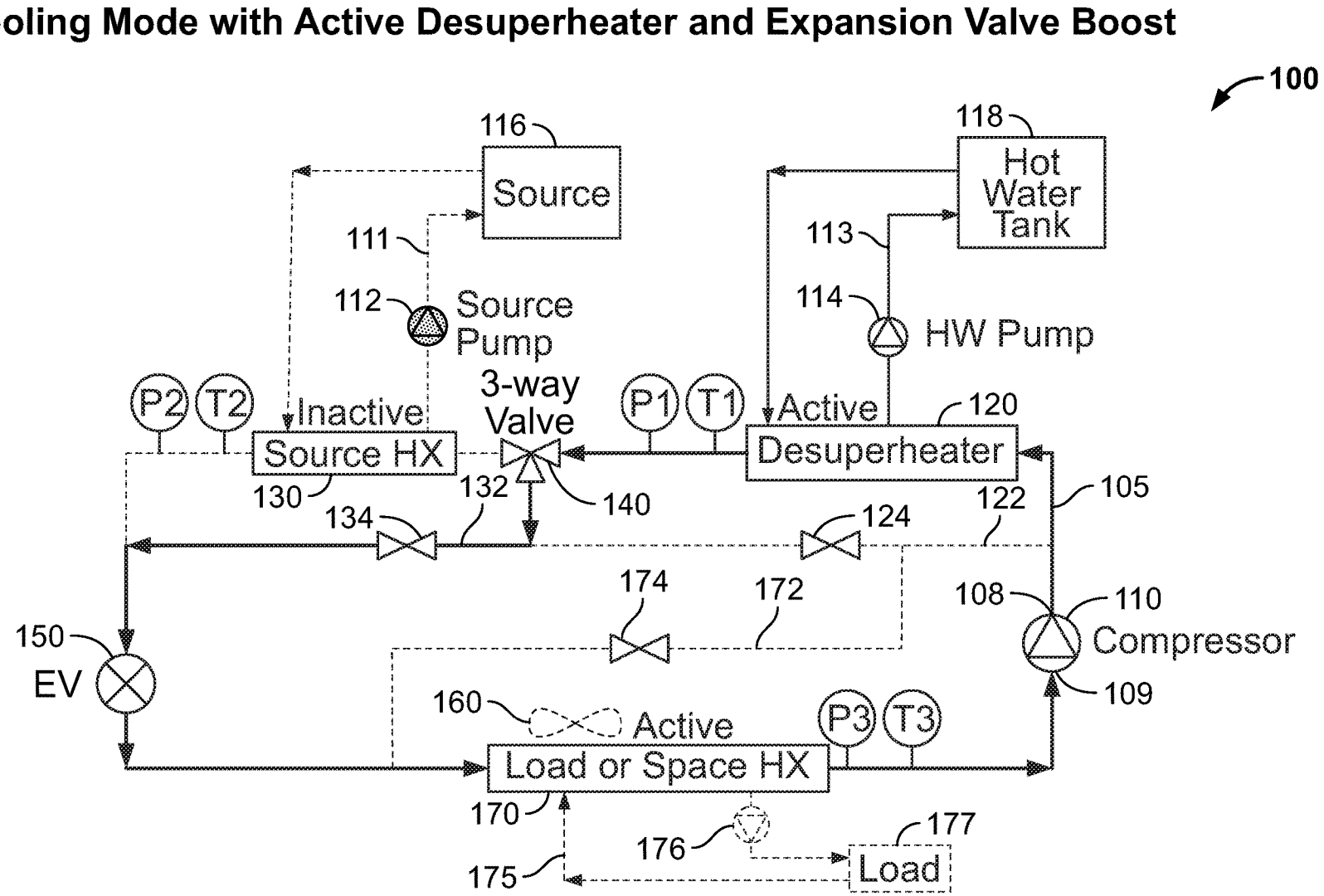
FIG. 4 is a schematic showing the HVAC system of FIG. 1 in a cooling mode with an active desuperheater and expansion valve boost.
Figure 5:
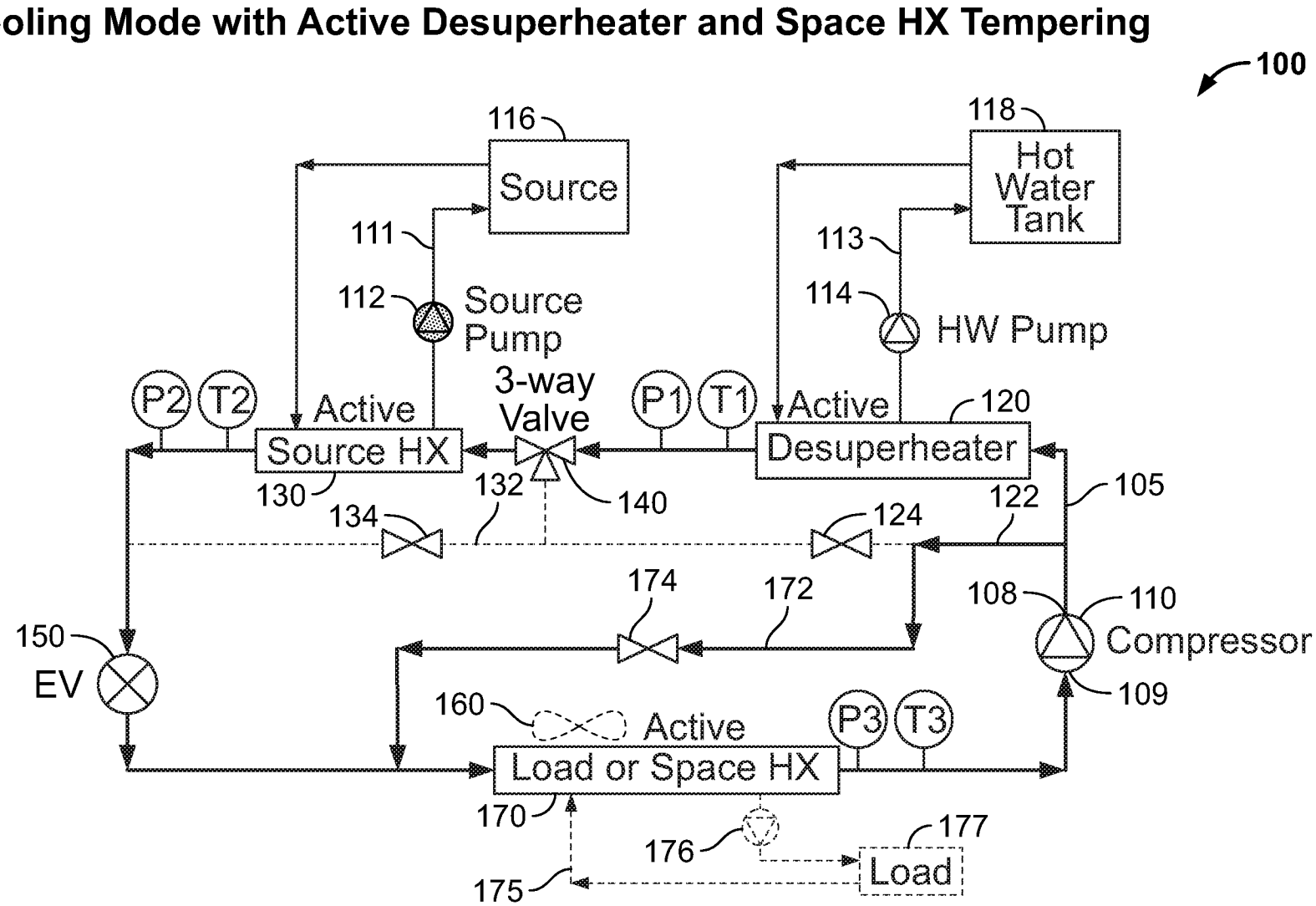
FIG. 5 is a schematic showing the HVAC system of FIG. 1 in a cooling mode with an active desuperheater and space heat exchanger tempering.
Figure 6:
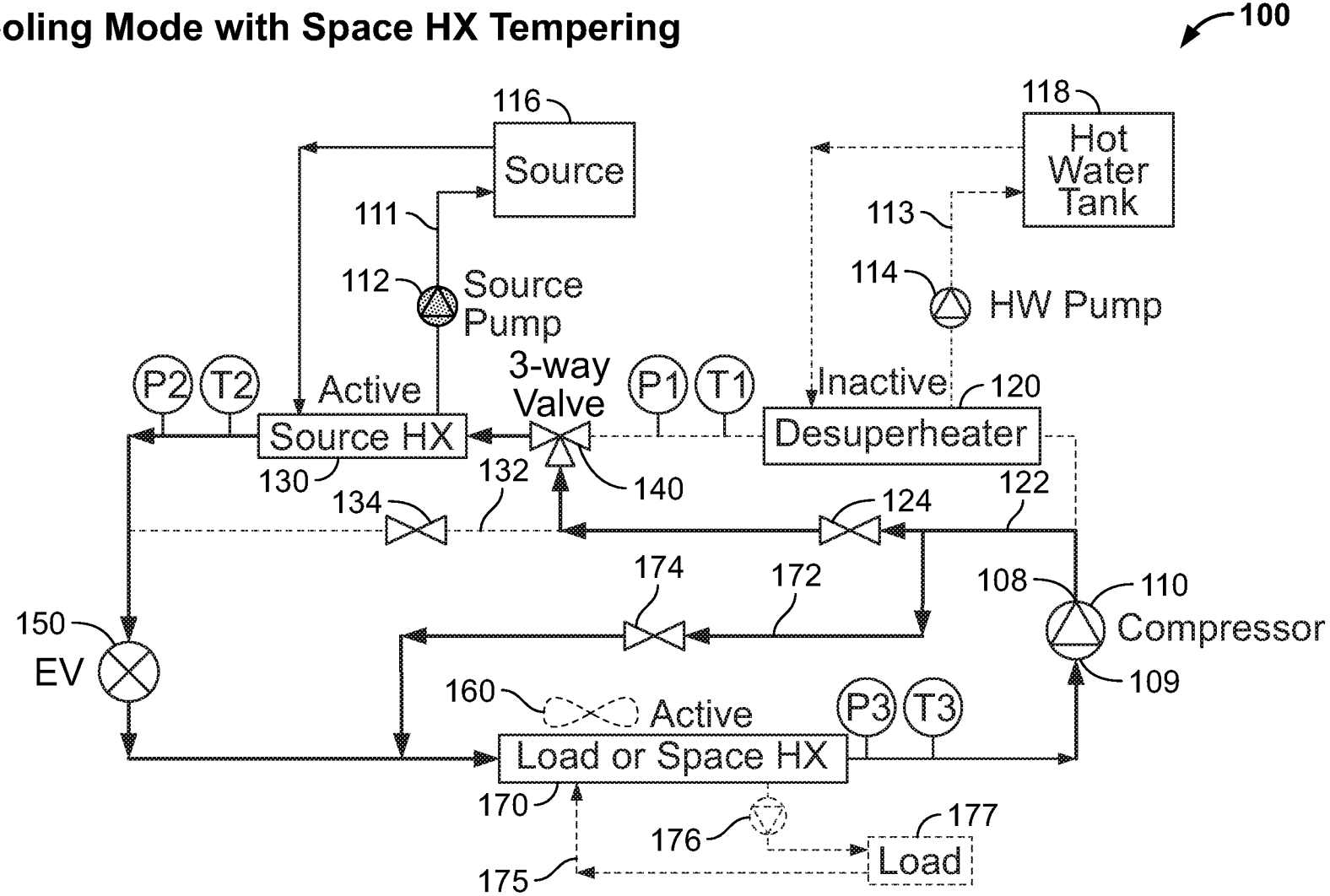
FIG. 6 is a schematic showing the HVAC system of FIG. 1 in a cooling mode with space heat exchanger tempering.

Turning now to the drawings and to FIGS. 1-6 in particular, there are shown various operating modes of HVAC system 100 configured to condition air in a space and optionally to heat water for domestic, commercial and/or industrial process purposes. FIG. 1 shows a representative schematic of hardware components for HVAC system 100. FIG. 2 shows HVAC system 100 configured to operate in a cooling mode. FIG. 3 shows HVAC system 100 configured to operate in a cooling mode with an active desuperheater. FIG. 4 shows HVAC system 100 configured to operate in a cooling mode with an active desuperheater and expansion valve boost. FIG. 5 shows HVAC system 100 configured to operate in a cooling mode with an active desuperheater and space heat exchanger tempering. FIG. 6 shows HVAC system 100 configured to operate in a cooling mode with space heat exchanger tempering.

Figure 19:
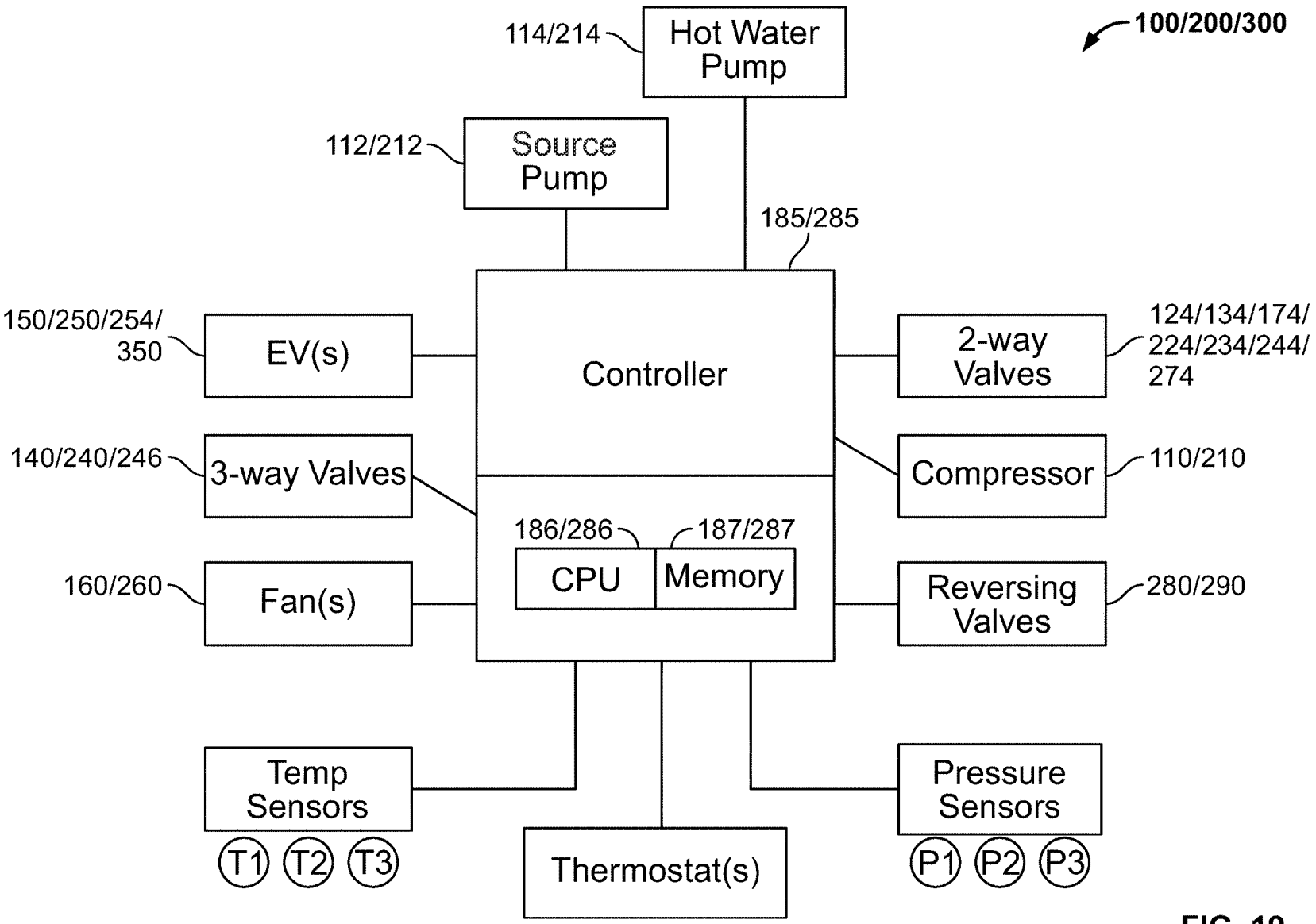
FIG. 19 is a schematic of a controller operable to control one or more aspects of any of the embodiments of the instant disclosure.

In the embodiment of FIGS. 1-6, HVAC system 100 includes refrigerant circuit 105 on which is disposed compressor 110; desuperheater heat exchanger 120; desuperheater bypass circuit 122 comprising bi-directional valve 124; source heat exchanger 130; source heat exchanger bypass circuit 132 comprising bi-directional valve 134; 3-way valve 140; expansion valve 150; load or space heat exchanger 170; bypass circuit 172 comprising bi-directional valve 174; pressure sensors P1, P2, and P3; temperature sensors T1, T2, and T3; and controller 185 (see FIG. 19). HVAC system 100 may include fan 160 for blowing air over load or space heat exchanger 170 configured as an refrigerant-to-air heat exchanger to condition air in a space. Alternatively, load or space heat exchanger 170 may be configured as a refrigerant-to-liquid heat exchanger to exchange heat with a liquid for any use, including conditioning air in a space or for industrial processes. For example, after exchanging heat with the refrigerant, the liquid may flow through fluid loop 175 by fluid pump 176 to load 177 and then back to the load or space heat exchanger 170. HVAC system 100 may be connected to source loop 111 comprising source fluid pump 112 configured to route source fluid to and from source 116. Source 116 may be any type of source, such as a fluid reservoir, a fluid cooler, or any type of heat of rejection/absorption device. HVAC system 100 may also be connected to hot water loop 113 comprising hot water pump 114 configured to pump water to and from water storage tank 118. Although not shown, it should be appreciated that HVAC system 100 may be configured to operate in corresponding heating modes by using a reversing valve, for example, to allow the direction of flow of refrigerant in the refrigerant circuit to be reversed from that shown in FIGS. 2-6. In addition, it would be appreciated that an expansion valve bypass circuit comprising a check valve may be positioned to bypass expansion valve 150, and that HVAC system 100 may include another expansion valve/expansion valve bypass circuit with check valve to control the direction of flow through these valves in a reversible refrigerant system. In this embodiment, desuperheater heat exchanger 120 and source heat exchanger 130 may be arranged in a common housing for ease of installation of HVAC system 100.

Referring to FIG. 2, HVAC system 100 is shown in a cooling mode with desuperheater heat exchanger 120 inactive. In this mode: (i) desuperheater port of 3-way valve 140 is closed to prohibit refrigerant flow through desuperheater heat exchanger 120, (ii) bi-directional valve 174 of bypass circuit 172 is closed to prohibit refrigerant flow through bypass circuit 172, (iii) bi-directional valve 124 of desuperheater bypass circuit 122 is open to allow refrigerant flow through desuperheater bypass circuit 122, (iv) bi-directional valve 134 is closed to prohibit refrigerant flow through source heat exchanger bypass circuit 132, and (v) source heat exchanger port of 3-way valve 140 is open to allow refrigerant flow through source heat exchanger 130. Compressed gaseous refrigerant exiting the compressor 110 at discharge outlet port 108 is conveyed to open bi-directional valve 124 of desuperheater bypass circuit 122 where the refrigerant is then conveyed to the desuperheater bypass port of 3-way valve 140. Three-way valve 140 then routes the refrigerant to source heat exchanger 130 acting as a condenser to exchange heat with the source fluid being conveyed through the source loop 111. The refrigerant leaving the source heat exchanger 130 is then conveyed to expansion valve 150. The refrigerant leaving expansion valve 150 is then conveyed to the load or space heat exchanger 170 acting as an evaporator, which then conveys the refrigerant to the suction inlet port 109 of the compressor 110 to continue the cycle. The capacity (e.g. speed) of source fluid pump 112 circulating the source fluid through source heat exchanger 130 may be adjusted to control heat rejected by the source heat exchanger 130 and system discharge pressure. The controller 185 may monitor temperature and pressure data reported to it from temperature sensors T2 and T3 and from pressure sensors P2 and P3 to determine subcooling and superheat, respectively, from source heat exchanger 130 and load or space heat exchanger 170.

Referring to FIG. 3, HVAC system 100 is shown configured in a cooling mode with an active desuperheater heat exchanger 120. In this mode: (i) desuperheater port of 3-way valve 140 is open to allow refrigerant flow through desuperheater heat exchanger 120, (ii) bi-directional valve 174 of bypass circuit 172 is closed to prohibit refrigerant flow through bypass circuit 172, (iii) bi-directional valve 124 of desuperheater bypass circuit 122 is closed to prohibit refrigerant flow through desuperheater bypass circuit 122, (iv) desuperheater/source heat exchanger bypass port of 3-way valve 140 is closed and bi-directional valve 134 is closed to prohibit refrigerant flow through source heat exchanger bypass circuit 132, and (v) source heat exchanger port of 3-way valve 140 is open to allow refrigerant flow through source heat exchanger 130. Compressed gaseous refrigerant exiting the compressor 110 at discharge outlet port 108 is conveyed through desuperheater heat exchanger 120 to exchange heat with the water being conveyed through the hot water loop 113, after which the refrigerant is then conveyed to 3-way valve 140. Three-way valve 140 then routes the refrigerant to source heat exchanger 130 acting as a condenser to exchange heat with the source fluid being conveyed through the source loop 111. The refrigerant leaving the source heat exchanger 130 is then conveyed to expansion valve 150. The refrigerant leaving expansion valve 150 is then conveyed to load or space heat exchanger 170 acting as an evaporator, which then conveys the refrigerant to the suction inlet port 109 of the compressor 110 to continue the cycle. In some variations of this operating mode, the controller 185 may command hot water pump 114 to turn off and therefore stop pumping water through hot water loop 113 if the temperature of the water exiting the desuperheater heat exchanger 120 is above a predetermined set point, such as 160° F. In addition to monitoring temperature and pressure data reported to it from temperature sensors T2 and T3 and from pressure sensors P2 and P3 to determine subcooling and superheat, respectively, from source heat exchanger 130 and load or space heat exchanger 170, controller 185 may also monitor temperature and pressure data reported to it from temperature sensor T1 and pressure sensor P1 to determine refrigerant conditions leaving the desuperheater heat exchanger 120.

Referring to FIG. 4, HVAC system 100 is shown configured in a cooling mode with an active desuperheater heat exchanger 120 and with expansion valve boost. In this mode: (i) desuperheater port of 3-way valve 140 is open to allow refrigerant flow through desuperheater heat exchanger 120, (ii) bi-directional valve 174 of bypass circuit 172 is closed to prohibit refrigerant flow through bypass circuit 172, (iii) bi-directional valve 124 of desuperheater bypass circuit 122 is closed to prohibit refrigerant flow through desuperheater bypass circuit 122, (iv) source heat exchanger bypass port of 3-way valve 140 is open and bi-directional valve 134 is open to allow refrigerant flow through source heat exchanger bypass circuit 132, and (v) source heat exchanger port of 3-way valve 140 is closed to prohibit refrigerant flow through source heat exchanger 130. Compressed gaseous refrigerant exiting the compressor 110 at discharge outlet port 108 is conveyed through desuperheater heat exchanger 120 to exchange heat with the water being conveyed through the hot water loop 113, after which the refrigerant is then conveyed to 3-way valve 140. Three-way valve 140 then routes the refrigerant to open bi-directional valve 134 of source heat exchanger bypass circuit 132 where the refrigerant is then conveyed to the expansion valve 150. The refrigerant leaving expansion valve 150 is then conveyed to load or space heat exchanger 170 acting as an evaporator, which then conveys the refrigerant to the suction inlet port 109 of the compressor 110 to continue the cycle.

Referring to FIG. 5, HVAC system 100 is shown configured in a cooling mode with an active desuperheater heat exchanger 120 and with load or space heat exchanger 170 tempering. In this mode: (i) desuperheater port of 3-way valve 140 is open to allow refrigerant flow through desuperheater heat exchanger 120, (ii) bi-directional valve 174 of bypass circuit 172 is open to allow refrigerant flow through bypass circuit 172, (iii) bi-directional valve 124 of desuperheater bypass circuit 122 is closed to prohibit refrigerant flow through desuperheater bypass circuit 122, (iv) desuperheater/source heat exchanger bypass port of 3-way valve 140 is closed and bi-directional valve 134 is closed to prohibit refrigerant flow through source heat exchanger bypass circuit 132, and (v) source heat exchanger port of 3-way valve 140 is open to allow refrigerant flow through source heat exchanger 130. Compressed gaseous refrigerant exiting the compressor 110 at discharge outlet port 108 is conveyed through desuperheater heat exchanger 120 to exchange heat with the water being conveyed through the hot water loop 113, after which the refrigerant is then conveyed to 3-way valve 140. Three-way valve 140 then routes the refrigerant to source heat exchanger 130 acting as a condenser to exchange heat with the source fluid being conveyed through the source loop 111. The refrigerant leaving the source heat exchanger 130 is then conveyed to expansion valve 150. The refrigerant leaving expansion valve 150 and the refrigerant conveyed by bypass circuit 172 are brought together and conveyed to load or space heat exchanger 170 acting as an evaporator, which then conveys the refrigerant to the suction inlet port 109 of the compressor 110 to continue the cycle. The controller 185 may be configured to control the opening of, and therefore the amount and/or rate of refrigerant passing through, bi-directional valve 174 to control the amount of refrigerant from bypass circuit 172 being mixed with the refrigerant exiting expansion valve 150 to control heat exchange occurring in load or space heat exchanger 170.

Referring to FIG. 6, HVAC system 100 is shown configured in a cooling mode with load or space heat exchanger 170 tempering and an inactive desuperheater heat exchanger 120. In this mode: (i) desuperheater port of 3-way valve 140 is closed to prohibit refrigerant flow through desuperheater heat exchanger 120, (ii) bi-directional valve 174 of bypass circuit 172 is open to allow refrigerant flow through bypass circuit 172, (iii) bi-directional valve 124 of desuperheater bypass circuit 122 is open to allow refrigerant flow through desuperheater bypass circuit 122, (iv) bi-directional valve 134 is closed to prohibit refrigerant flow through source heat exchanger bypass circuit 132, and (v) source heat exchanger port of 3-way valve 140 is open to allow refrigerant flow through source heat exchanger 130. Compressed gaseous refrigerant exiting the compressor 110 at discharge outlet port 108 is conveyed to open bi-directional valve 124 of desuperheater bypass circuit 122 where the refrigerant is then conveyed to the desuperheater bypass port of 3-way valve 140. Three-way valve 140 then routes the refrigerant to source heat exchanger 130 acting as a condenser to exchange heat with the source fluid being conveyed through the source loop 111. The refrigerant leaving the source heat exchanger 130 is then conveyed to expansion valve 150. In this mode, compressed gaseous refrigerant exiting the compressor 110 at discharge outlet port 108 is also conveyed to open bi-directional valve 174 of bypass circuit 172. The refrigerant leaving expansion valve 150 and the refrigerant conveyed by bypass circuit 172 are brought together and conveyed to load or space heat exchanger 170 acting as an evaporator, which then conveys the refrigerant to the suction inlet port 109 of the compressor 110 to continue the cycle. The controller 185 may be configured to control the opening of, and therefore the amount and/or rate of refrigerant passing through, one or both of bi-directional valves 124, 174 to control the amount of heat exchange occurring in source heat exchanger 130 and load or space heat exchanger 170.

With respect to any of the foregoing operating modes shown in FIGS. 2-6, the controller 185 may monitor temperature and pressure data reported to it from temperature sensors T1, T2 and T3 and from pressure sensors P1, P2 and P3, as applicable according to the respective operating mode, to determine if the refrigerant is expanding, condensing or in a steady state. With this information, the controller 185 may adjust, as needed, the opening of the 3-way valve 140, the opening of any of the bi-directional valves 124, 174,134, the opening of the expansion valve 150, the configuration of any reversing valves, the speed of the compressor 110, the speed of the source fluid pump 112, the speed of the hot water pump 114, and the speed of the fan 160 to adjust the refrigerant mass flow and quality and to optimize the efficiency of the refrigeration cycle. In addition, a fewer or greater number of temperature and pressure sensors may be utilized and positioned at different locations than what is shown in the figures. For example, temperature and/or pressure sensors may be positioned at both the inlet and the discharge locations of any heat exchanger in the system. In addition, temperature sensors and flow sensors may be positioned along one or both of the source loop 111 and the hot water loop 113.

Figure 7:
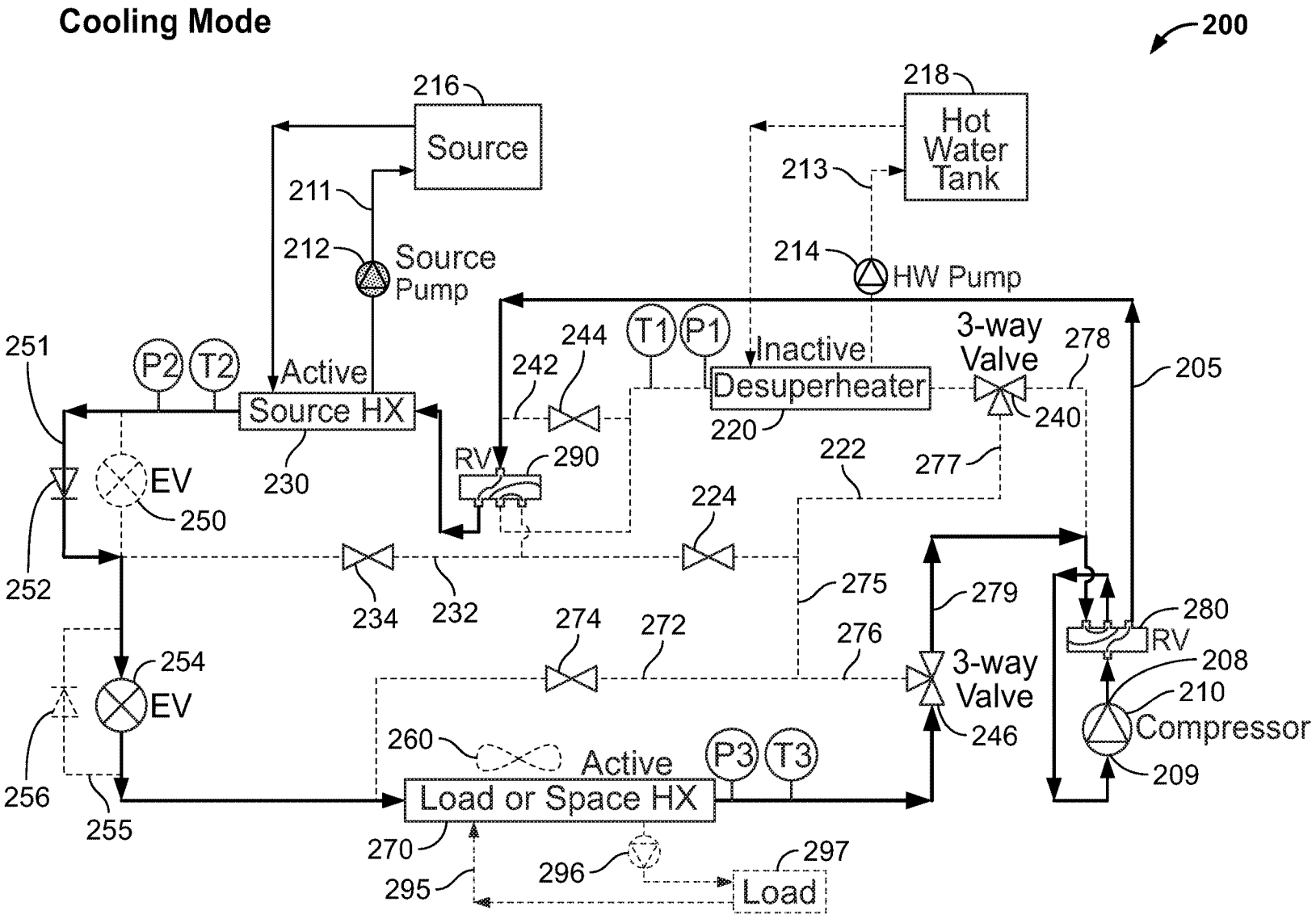
FIG. 7 is a schematic showing another embodiment of an HVAC system of the instant disclosure in a cooling mode.
Figure 8:
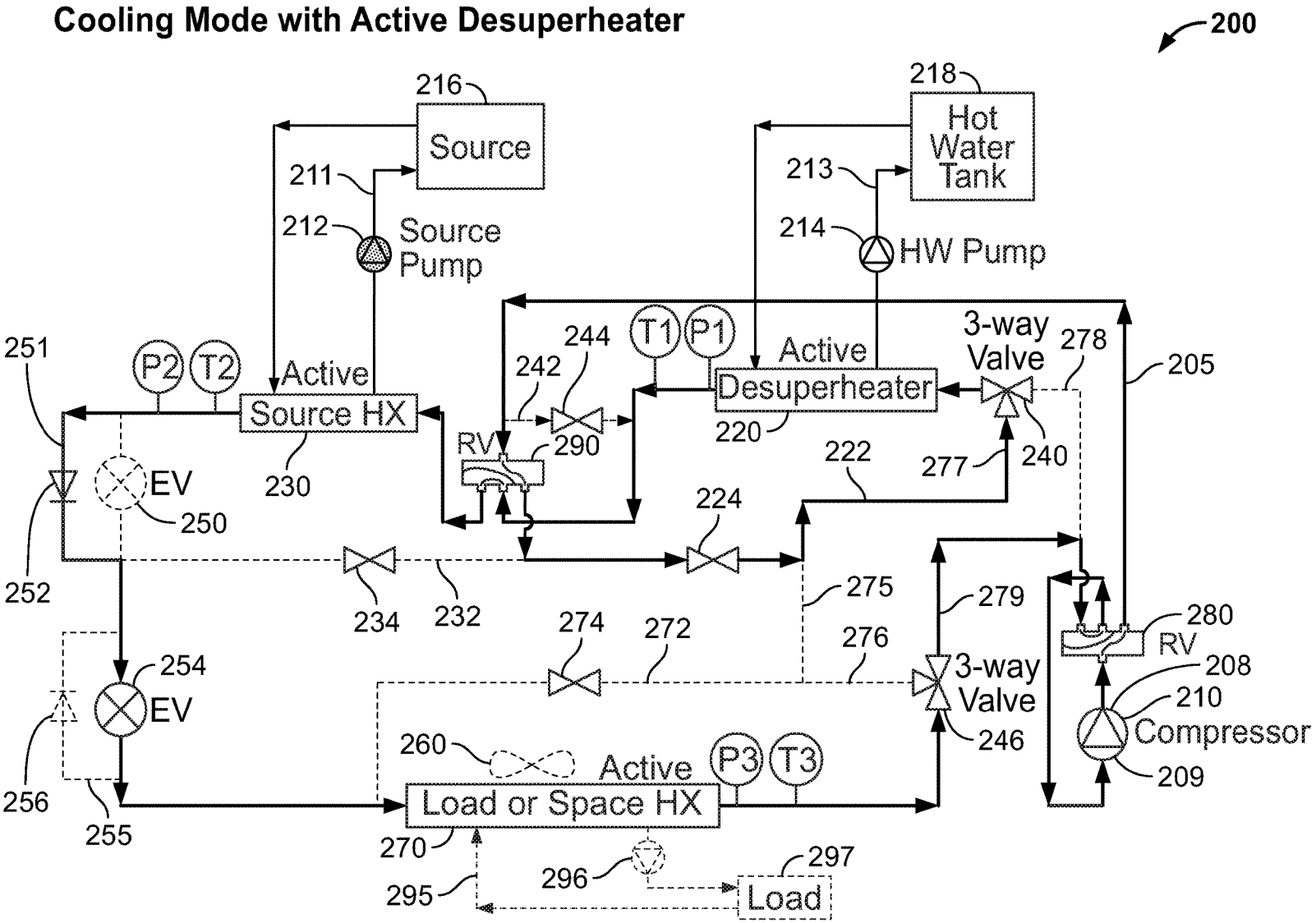
FIG. 8 is a schematic showing the HVAC system of FIG. 7 in a cooling mode with an active desuperheater.
Figure 9:
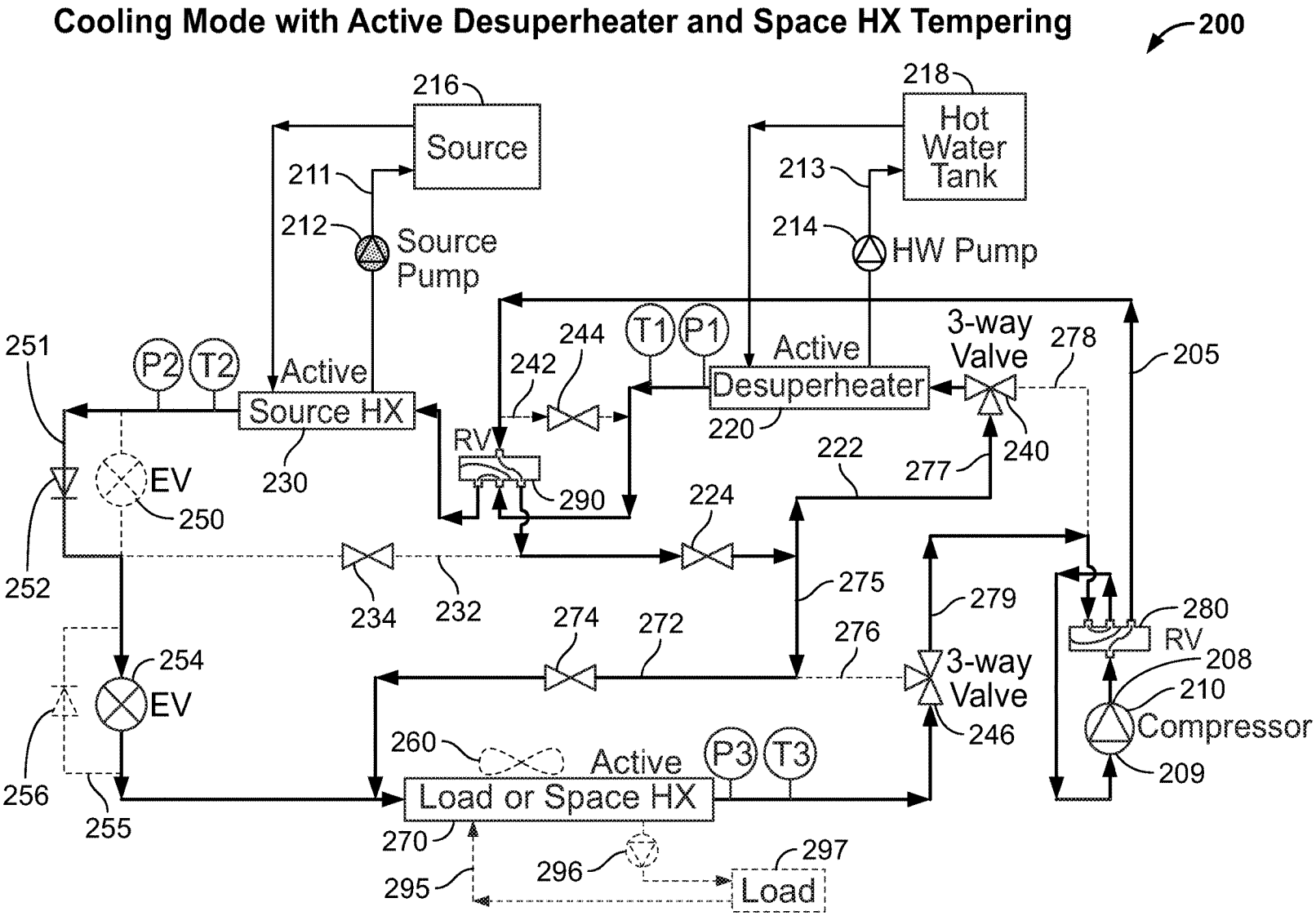
FIG. 9 is a schematic showing the HVAC system of FIG. 7 in a cooling mode with an active desuperheater and space heat exchanger tempering.
Figure 10:
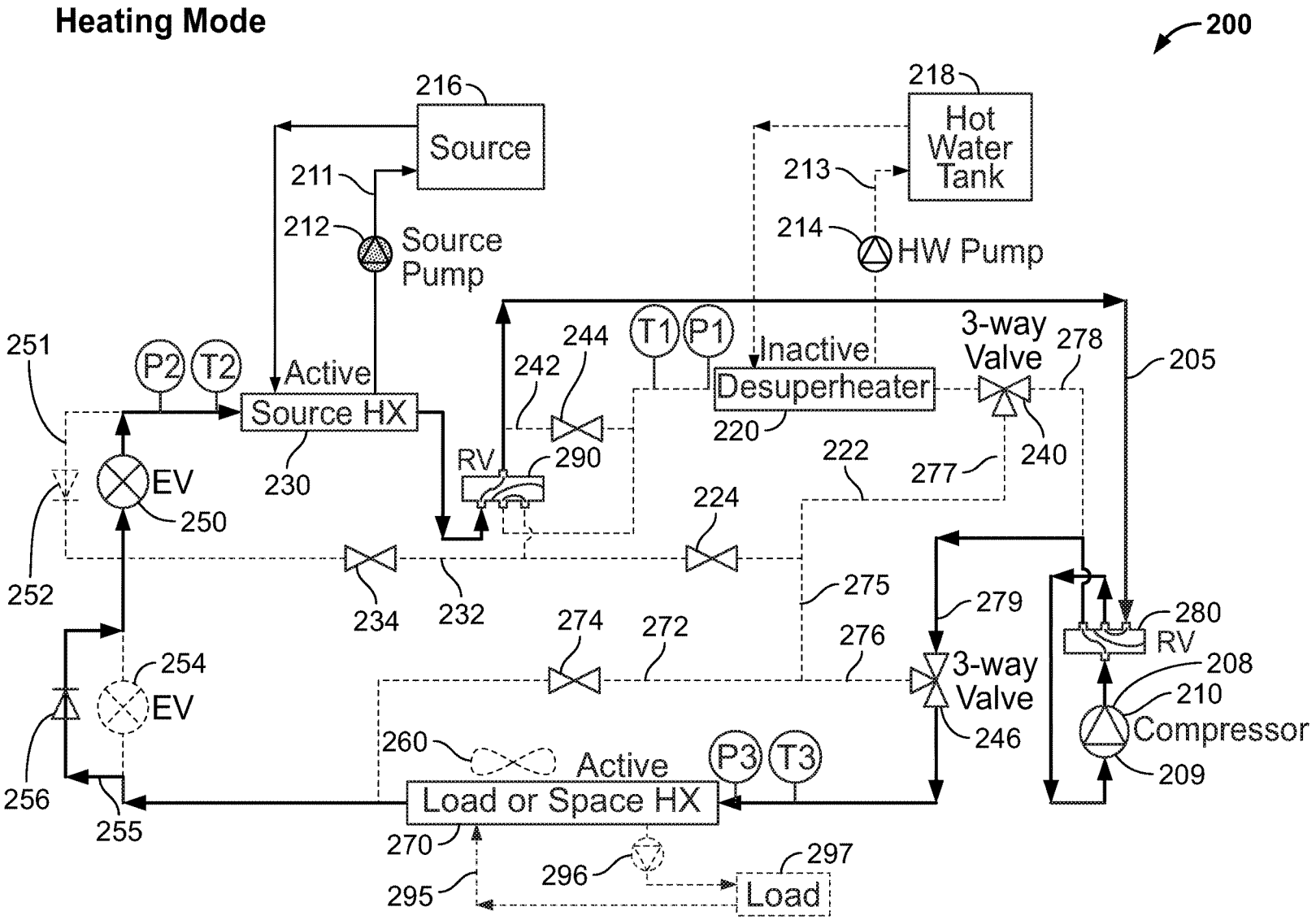
FIG. 10 is a schematic showing the HVAC system of FIG. 7 in a heating mode.
Figure 11:
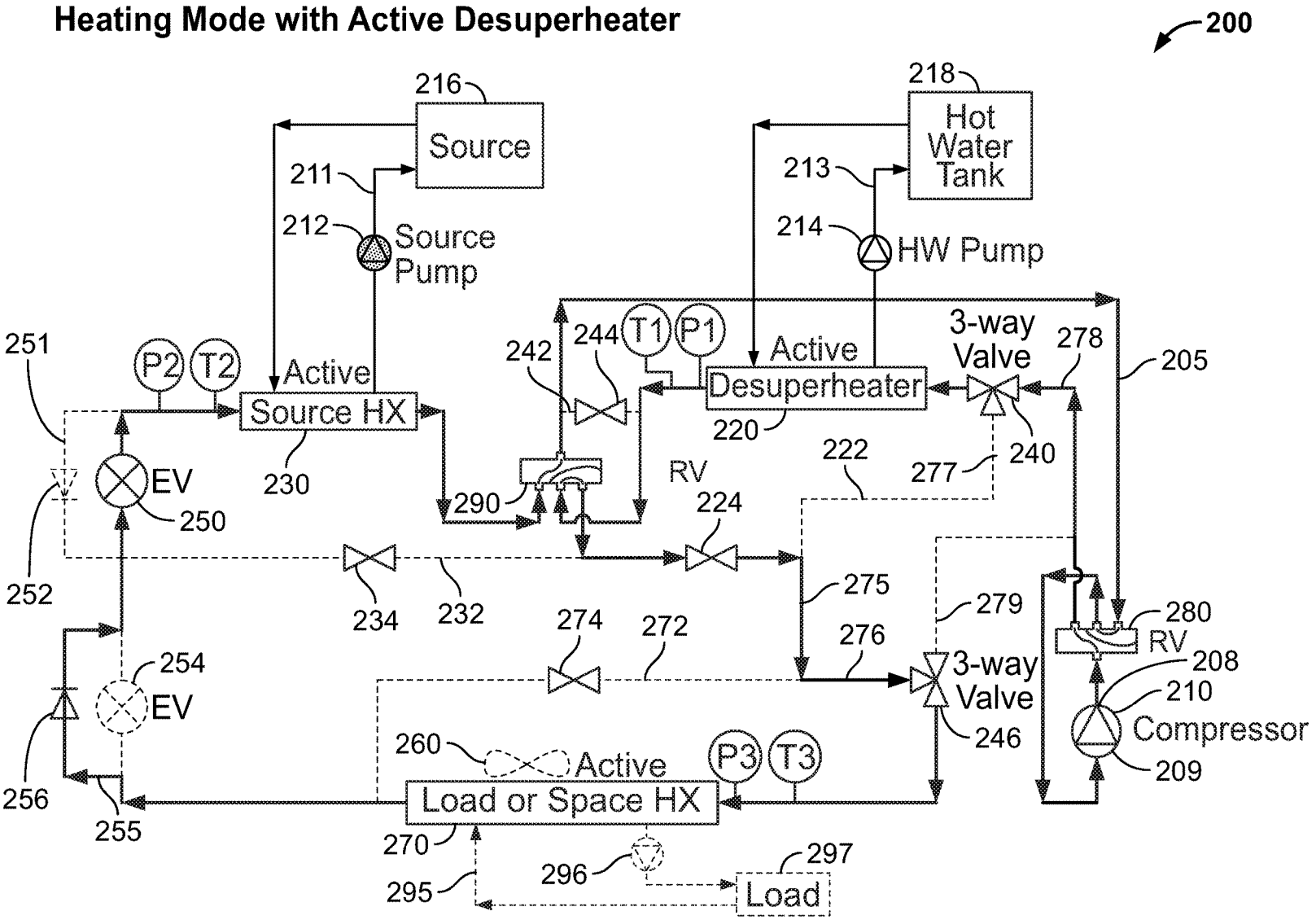
FIG. 11 is a schematic showing the HVAC system of FIG. 7 in a heating mode with an active desuperheater.
Figure 12:
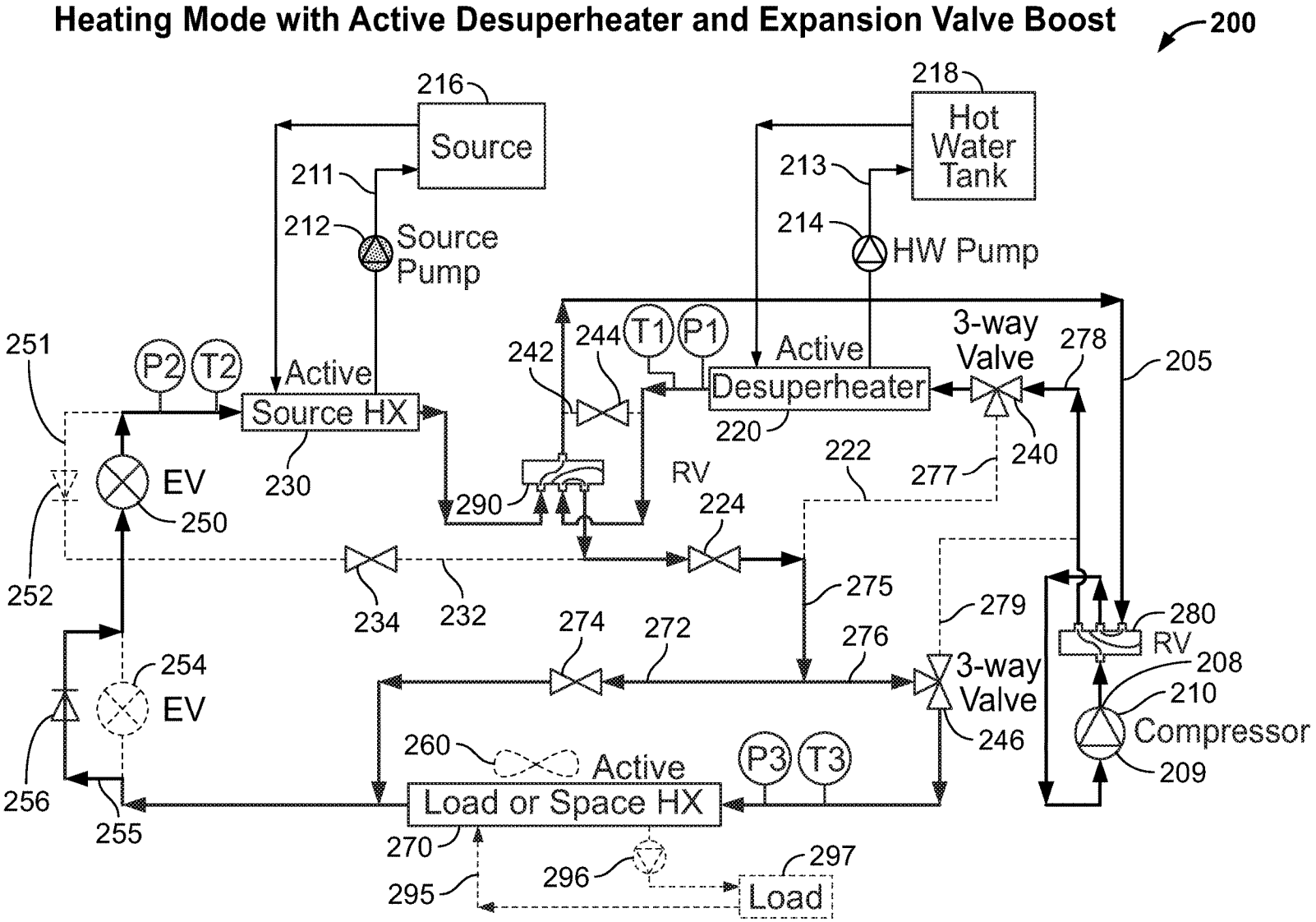
FIG. 12 is a schematic showing the HVAC system of FIG. 7 in a heating mode with an active desuperheater and expansion valve boost.

Turning now to FIGS. 7-12, there are shown various operating modes of HVAC system 200 configured to condition air in a space and optionally to heat water for domestic, commercial, or industrial process uses. FIG. 7 shows HVAC system 200 configured to operate in a cooling mode. FIG. 8 shows HVAC system 200 configured to operate in a cooling mode with an active desuperheater. FIG. 9 shows HVAC system 200 configured to operate in a cooling mode with an active desuperheater and space heat exchanger tempering. FIG. 10 shows HVAC system 200 configured to operate in a heating mode. FIG. 11 shows HVAC system 200 configured to operate in a heating mode with an active desuperheater. FIG. 12 shows HVAC system 200 configured to operate in a heating mode with an active desuperheater and expansion valve boost.

In the embodiment of FIGS. 7-12, HVAC system 200 includes refrigerant circuit 205 on which is disposed compressor 210; reversing valves 280,290; desuperheater heat exchanger 220; desuperheater loop 222 comprising bi-directional valve 224; source heat exchanger 230; 3-way valves 240,246; expansion valves 250,254; expansion valve bypass circuits 251,255 comprising check valves 252,256; load or space heat exchanger 270; bypass circuit 272 comprising bi-directional valve 274; bypass circuits 232,242 comprising bi-directional valves 234,244; pressure sensors P1, P2, and P3; temperature sensors T1, T2, and T3; and controller 285 (see FIG. 19). HVAC system 200 may include fan 260 (not shown) for blowing air over load or space heat exchanger 270 configured as an refrigerant-to-air heat exchanger to condition air in a space. Alternatively, load or space heat exchanger 270 may be configured as a refrigerant-to-liquid heat exchanger to exchange heat with a liquid for any use, including conditioning air in a space or for industrial processes. For example, after exchanging heat with the refrigerant, the liquid may flow through fluid loop 295 by fluid pump 296 to load 297 and then back to the load or space heat exchanger 270. HVAC system 200 may be connected to source loop 211 comprising source fluid pump 212 configured to route source fluid to and from source 216. Source 216 may be any type of source, such as a fluid reservoir, a fluid cooler, or any type of heat of rejection/absorption device. HVAC system 200 may also be connected to hot water loop 213 comprising hot water pump 214 configured to pump water to and from water storage tank 218. In this embodiment, desuperheater heat exchanger 220 and source heat exchanger 230 may be arranged in a common housing for ease of installation of HVAC system 200.

Referring to FIG. 7, HVAC system 200 is shown in a cooling mode with desuperheater heat exchanger 220 inactive. In this mode: (i) all ports of 3-way valve 240 are closed to prohibit refrigerant flow through desuperheater heat exchanger 220 and to urge refrigerant leaving 3-way valve 246 to flow to reversing valve 280, (ii) bi-directional valve 274 of bypass circuit 272 is closed to prohibit refrigerant flow through bypass circuit 272, (iii) bi-directional valve 224 of desuperheater loop 222 is closed to prohibit refrigerant flow through desuperheater loop 222, (iv) bi-directional valves 234,244 are closed to prohibit refrigerant flow through bypass circuits 232,242 and (v) the port of 3-way valve 246 that is connected to conduit 276 is closed to prohibit refrigerant flow to bypass circuit 272 and to desuperheater loop 222. Compressed gaseous refrigerant exiting the compressor 210 at discharge outlet port 208 is conveyed to reversing valve 280, which directs the refrigerant to reversing valve 290, where the refrigerant is then conveyed to the source heat exchanger 230 acting as a condenser to exchange heat with the source fluid being conveyed through the source loop 211. The refrigerant leaving the source heat exchanger 230 is then conveyed to expansion valve bypass circuit 251, through check valve 252, and then to expansion valve 254. The refrigerant leaving expansion valve 254 is then conveyed to load or space heat exchanger 270 acting as an evaporator, which then conveys the refrigerant to the 3-way valve 246, which routes the refrigerant to reversing valve 280, which routes the refrigerant to the suction inlet port 209 of the compressor 210 to continue the cycle. As discussed above for FIGS. 1-6, the capacity (e.g. speed) of source fluid pump 212 circulating the source fluid through source heat exchanger 230 may be adjusted to control heat rejected by the source heat exchanger 230 and system discharge pressure. The controller 285 may monitor temperature and pressure data reported to it from temperature sensors T2 and T3 and from pressure sensors P2 and P3 to determine subcooling and superheat, respectively, from source heat exchanger 230 and load or space heat exchanger 270.

Referring to FIG. 8, HVAC system 200 is shown in a cooling mode with an active desuperheater heat exchanger 220. In this mode: (i) two desuperheater ports of 3-way valve 240 are open to allow refrigerant flow through desuperheater heat exchanger 220 while the port of 3-way valve 240 connected to conduit 278 is closed to prohibit refrigerant flow to reversing valve 280 and to urge refrigerant leaving 3-way valve 246 to be directed to reversing valve 280, (ii) bi-directional valve 274 of bypass circuit 272 is closed to prohibit refrigerant flow through bypass circuit 272, (iii) bi-directional valve 224 of desuperheater loop 222 is open to allow refrigerant flow through desuperheater heat exchanger 220, (iv) bi-directional valves 234,244 are closed to prohibit refrigerant flow through bypass circuits 232,242, and (v) acting in concert with the closed bi-directional valve 274, the port of 3-way valve 246 that is connected to conduit 276 is closed to prohibit refrigerant flow through bypass circuit 272 and to 3-way valve 246. Compressed gaseous refrigerant exiting the compressor 210 at discharge outlet port 208 of refrigerant circuit 205 is conveyed to reversing valve 280, which directs the refrigerant to reversing valve 290, which conveys the refrigerant to open bi-directional valve 224, which conveys the refrigerant to 3-way valve 240, which conveys the refrigerant to desuperheater heat exchanger 220 to exchange heat with the water being conveyed through the hot water loop 213. Refrigerant leaving the desuperheater heat exchanger 220 is conveyed through reversing valve 290, then to the source heat exchanger 230 acting as a condenser to exchange heat with the source fluid being conveyed through the source loop 211. The refrigerant leaving the source heat exchanger 230 is conveyed to expansion valve bypass circuit 251, through check valve 252, and then to expansion valve 254. The refrigerant leaving expansion valve 254 is then conveyed to load or space heat exchanger 270 acting as an evaporator, which then conveys the refrigerant to the 3-way valve 246, which routes the refrigerant to reversing valve 280, which routes the refrigerant to the suction inlet port 209 of the compressor 210 to continue the cycle. In some variations of this operating mode, the controller 285 may command hot water pump 214 to turn off and therefore stop pumping water through hot water loop 213 if the temperature of the water exiting the desuperheater heat exchanger 220 is above a predetermined set point, such as 160° F. In addition to monitoring temperature and pressure data reported to it from temperature sensors T2 and T3 and from pressure sensors P2 and P3 to determine subcooling and superheat, respectively, from source heat exchanger 230 and load or space heat exchanger 270, controller 285 may also monitor temperature and pressure data reported to it from temperature sensor T1 and pressure sensor P1 to determine refrigerant conditions leaving the desuperheater heat exchanger 220.

Referring to FIG. 9, HVAC system 200 is shown in a cooling mode with an active desuperheater heat exchanger 220 and load or space heat exchanger 270 tempering. In this mode: (i) two desuperheater ports of 3-way valve 240 are open to allow refrigerant flow through desuperheater heat exchanger 220 while the port of 3-way valve 240 connected to conduit 278 is closed to prohibit refrigerant flow to reversing valve 280 and to urge refrigerant leaving 3-way valve 246 to be directed to reversing valve 280, (ii) bi-directional valve 274 of bypass circuit 272 is open to allow refrigerant flow through bypass circuit 272, (iii) bi-directional valve 224 of desuperheater loop 222 is open to allow refrigerant flow through desuperheater heat exchanger 220 and through bypass circuit 272, (iv) bi-directional valves 234,244 are closed to prohibit refrigerant flow through bypass circuits 232,242, and (v) the port of 3-way valve 246 that is connected to conduit 276 is closed to urge refrigerant to flow through bypass circuit 272 and not to 3-way valve 246. Compressed gaseous refrigerant exiting the compressor 210 at discharge outlet port 208 of refrigerant circuit 205 is conveyed to reversing valve 280, which directs the refrigerant to reversing valve 290, which conveys the refrigerant to open bi-directional valve 224, which conveys a first portion of the refrigerant to 3-way valve 240, which conveys the refrigerant to desuperheater heat exchanger 220 to exchange heat with the water being conveyed through the hot water loop 213. Refrigerant leaving the desuperheater heat exchanger 220 is conveyed through reversing valve 290, then to the source heat exchanger 230 acting as a condenser to exchange heat with the source fluid being conveyed through the source loop 211. The refrigerant leaving the source heat exchanger 230 is conveyed to expansion valve bypass circuit 251, through check valve 252, and then to expansion valve 254. In addition, a second portion of the refrigerant leaving bi-directional valve 224 is conveyed to bypass circuit 272 through open bi-directional valve 274 and is brought together with the first portion of the refrigerant leaving the expansion valve 254 and conveyed to load or space heat exchanger 270 acting as an evaporator. Refrigerant leaving load or space heat exchanger 270 is conveyed to 3-way valve 246, which routes the refrigerant to reversing valve 280, which routes the refrigerant to the suction inlet port 209 of the compressor 210 to continue the cycle. The controller 285 may be configured to control the opening of, and therefore the amount and/or rate of refrigerant passing through, bi-directional valve 274 and/or 3-way valve 240 to control the amount of the refrigerant being conveyed through bypass circuit 272 that is mixed with the refrigerant exiting expansion valve 254 to control heat exchange occurring in load or space heat exchanger 270. In some variations of this operating mode, the controller 285 may command hot water pump 214 to turn off and therefore stop pumping water through hot water loop 213 if the temperature of the water exiting the desuperheater heat exchanger 220 is above a predetermined set point, such as 160° F. In addition to monitoring temperature and pressure data reported to it from temperature sensors T2 and T3 and from pressure sensors P2 and P3 to determine subcooling and superheat, respectively, from source heat exchanger 230 and load or space heat exchanger 270, controller 285 may also monitor temperature and pressure data reported to it from temperature sensor T1 and pressure sensor P1 to determine refrigerant conditions leaving the desuperheater heat exchanger 220.

Referring to FIG. 10, HVAC system 200 is shown in a heating mode with desuperheater heat exchanger 220 inactive. In this mode: (i) all ports of 3-way valve 240 are closed to prohibit refrigerant flow through desuperheater heat exchanger 220 and to urge compressed gaseous refrigerant leaving reversing valve 280 to flow to 3-way valve 246, (ii) bi-directional valve 274 of bypass circuit 272 is closed to prohibit refrigerant flow through bypass circuit 272, (iii) bi-directional valve 224 of desuperheater loop 222 is closed to prohibit refrigerant flow to reversing valve 290, (iv) bi-directional valves 234,244 are closed to prohibit refrigerant flow through bypass circuits 232,242 and (v) the port of 3-way valve 246 that is connected to conduit 276 is closed to prohibit refrigerant flow from 3-way valve 246 to bypass circuit 272 and to desuperheater loop 222. Compressed gaseous refrigerant exiting the compressor 210 at discharge outlet port 208 of refrigerant circuit 205 is conveyed to 3-way valve 246, which conveys the refrigerant to load or space heat exchanger 270 acting as an evaporator. Refrigerant leaving the load or space heat exchanger 270 is convey to expansion valve bypass circuit 255, through check valve 256, and then to expansion valve 250. The refrigerant leaving expansion valve 250 is then conveyed to source heat exchanger 230 acting as an evaporator to exchange heat with the source fluid being conveyed through the source loop 211. The refrigerant leaving source heat exchanger 230 is conveyed to reversing valve 290, which directs the refrigerant to reversing valve 280, which directs the refrigerant to suction inlet port 209 of compressor 210 to continue the cycle. As discussed above for FIGS. 1-6 and 7, the capacity (e.g. speed) of source fluid pump 212 circulating the source fluid through source heat exchanger 230 may be adjusted to control heat rejected by the source heat exchanger 230 and system discharge pressure.

Referring to FIG. 11, HVAC system 200 is shown in a heating mode with an active desuperheater heat exchanger 220. In this mode: (i) two desuperheater ports of 3-way valve 240 are open to allow refrigerant flow through desuperheater heat exchanger 220 while the port of 3-way valve 240 connected to conduit 277 is closed to prohibit refrigerant flow to conduit 277 and to urge refrigerant leaving bi-directional valve 224 to be directed to conduits 275,276, which convey the refrigerant to 3-way valve 246, (ii) bi-directional valve 274 of bypass circuit 272 is closed to prohibit refrigerant flow through bypass circuit 272, (iii) bi-directional valve 224 is open to allow refrigerant to flow to conduits 275,276, which convey the refrigerant to 3-way valve 246, (iv) bi-directional valves 234,244 are closed to prohibit refrigerant flow through bypass circuits 232,242, and (v) the port of 3-way valve 246 that is connected to conduit 276 is open to allow refrigerant to be conveyed by conduits 275,276 to 3-way valve 246 while the port of 3-way valve 246 that is connected to conduit 279 is closed to prohibit refrigerant from flowing to or from reversing valve 280. Compressed gaseous refrigerant exiting the compressor 210 at discharge outlet port 208 of refrigerant circuit 205 is conveyed to 3-way valve 240, which conveys the refrigerant to desuperheater heat exchanger 220 to exchange heat with the water being conveyed through the hot water loop 213. Refrigerant leaving the desuperheater heat exchanger 220 is conveyed through reversing valve 290, which routes the refrigerant through open bi-directional valve 224. The refrigerant is then conveyed by conduits 275,276 to 3-way valve 246, which conveys the refrigerant to load or space heat exchanger 270 acting as an evaporator. Refrigerant leaving the load or space heat exchanger 270 is conveyed to expansion valve bypass circuit 255, through check valve 256, and then to expansion valve 250. The refrigerant leaving expansion valve 250 is then conveyed to source heat exchanger 230 acting as a evaporator to exchange heat with the source fluid being conveyed through the source loop 211. The refrigerant leaving source heat exchanger 230 is conveyed to reversing valve 290, which directs the refrigerant to reversing valve 280, which directs the refrigerant to suction inlet port 209 of compressor 210 to continue the cycle. In some variations of this operating mode, the controller 285 may command hot water pump 214 to turn off and therefore stop pumping water through hot water loop 213 if the temperature of the water exiting the desuperheater heat exchanger 220 is above a predetermined set point, such as 160° F. In addition to monitoring temperature and pressure data reported to it from temperature sensors T2 and T3 and from pressure sensors P2 and P3, controller 285 may also monitor temperature and pressure data reported to it from temperature sensor T1 and pressure sensor P1 to determine refrigerant conditions leaving the desuperheater heat exchanger 220.

Referring to FIG. 12, HVAC system 200 is shown in a heating mode with an active desuperheater heat exchanger 220 and expansion valve boost for ensuring that expansion valve 254 will control the system properly and to avoid flashing of refrigerant prior to entry into the source heat exchanger 230. In this mode: (i) two desuperheater ports of 3-way valve 240 are open to allow refrigerant flow through desuperheater heat exchanger 220 while the port of 3-way valve 240 connected to conduit 277 is closed to prohibit refrigerant flow to conduit 277 and to urge refrigerant leaving bi-directional valve 224 to be directed to conduit 275, (ii) bi-directional valve 274 of bypass circuit 272 is open to cause a portion of the refrigerant to bypass the load or space heat exchanger 270 to provide boost to expansion valve 250, (iii) bi-directional valve 224 is open to allow refrigerant to flow to conduit 275 and then to bi-directional valve 274 and to 3-way valve 246, (iv) bi-directional valves 234,244 are closed to prohibit refrigerant flow through bypass circuits 232,242, and (v) the port of 3-way valve 246 that is connected to conduit 276 is open to allow refrigerant to be conveyed by conduits 275,276 to 3-way valve 246 while the port of 3-way valve 246 that is connected to conduit 279 is closed to prohibit refrigerant from flowing to or from reversing valve 280. Compressed gaseous refrigerant exiting the compressor 210 at discharge outlet port 208 of refrigerant circuit 205 is conveyed to 3-way valve 240, which conveys the refrigerant to desuperheater heat exchanger 220 to exchange heat with the water being conveyed through the hot water loop 213. Refrigerant leaving the desuperheater heat exchanger 220 is conveyed through reversing valve 290, which routes the refrigerant through open bi-directional valve 224. The controller 285 may be configured to control the opening of, and therefore the amount and/or rate of refrigerant passing through, bi-directional valve 274 and/or 3-way valve 246 to control the amount of the refrigerant being conveyed through bypass circuit 272 that is mixed with the refrigerant exiting load or space heat exchanger 270 to provide a boost to the inlet conditions of the refrigerant entering expansion valve 254. Consequently, upon leaving the bi-directional valve 224, a first portion of the refrigerant is conveyed to the 3-way valve 246 and a second portion of the refrigerant is conveyed to open bi-directional valve 274 where the amount of the first and second portions is determined by the orifice sizes commanded by controller 285 in the respective 3-way valve 246 and bi-directional valve 274. The first portion of the refrigerant leaving the 3-way valve is conveyed to load or space heat exchanger 270 acting as an evaporator while the second portion of the refrigerant leaving bi-directional valve 274 of bypass circuit 272 bypasses the load or space heat exchanger 270 and is mixed with the first portion of the refrigerant leaving the load or space heat exchanger 270. All of the refrigerant is then conveyed to expansion valve bypass circuit 255, through check valve 256, and then to expansion valve 250. The refrigerant leaving expansion valve 250 is then conveyed to source heat exchanger 230 acting as a evaporator to exchange heat with the source fluid being conveyed through the source loop 211. The refrigerant leaving source heat exchanger 230 is conveyed to reversing valve 290, which directs the refrigerant to reversing valve 280, which directs the refrigerant to suction inlet port 209 of compressor 210 to continue the cycle. In some variations of this operating mode, the controller 285 may command hot water pump 214 to turn off and therefore stop pumping water through hot water loop 213 if the temperature of the water exiting the desuperheater heat exchanger 220 is above a predetermined set point, such as 160° F. In addition to monitoring temperature and pressure data reported to it from temperature sensors T2 and T3 and from pressure sensors P2 and P3, controller 285 may also monitor temperature and pressure data reported to it from temperature sensor T1 and pressure sensor P1 to determine refrigerant conditions leaving the desuperheater heat exchanger 220.

Figure 13:
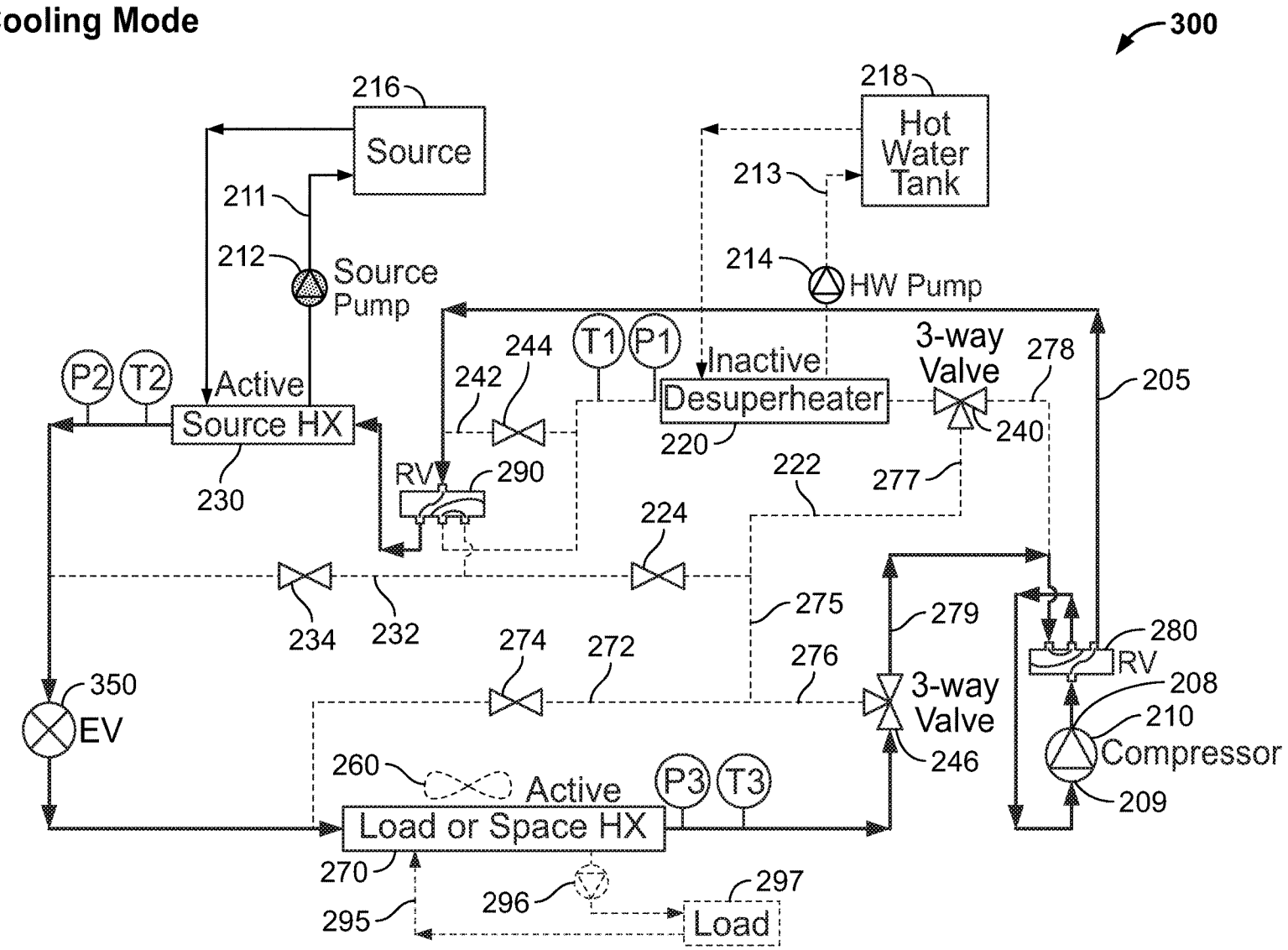
FIG. 13 is a schematic showing another embodiment of an HVAC system of the instant disclosure in a cooling mode.
Figure 14:
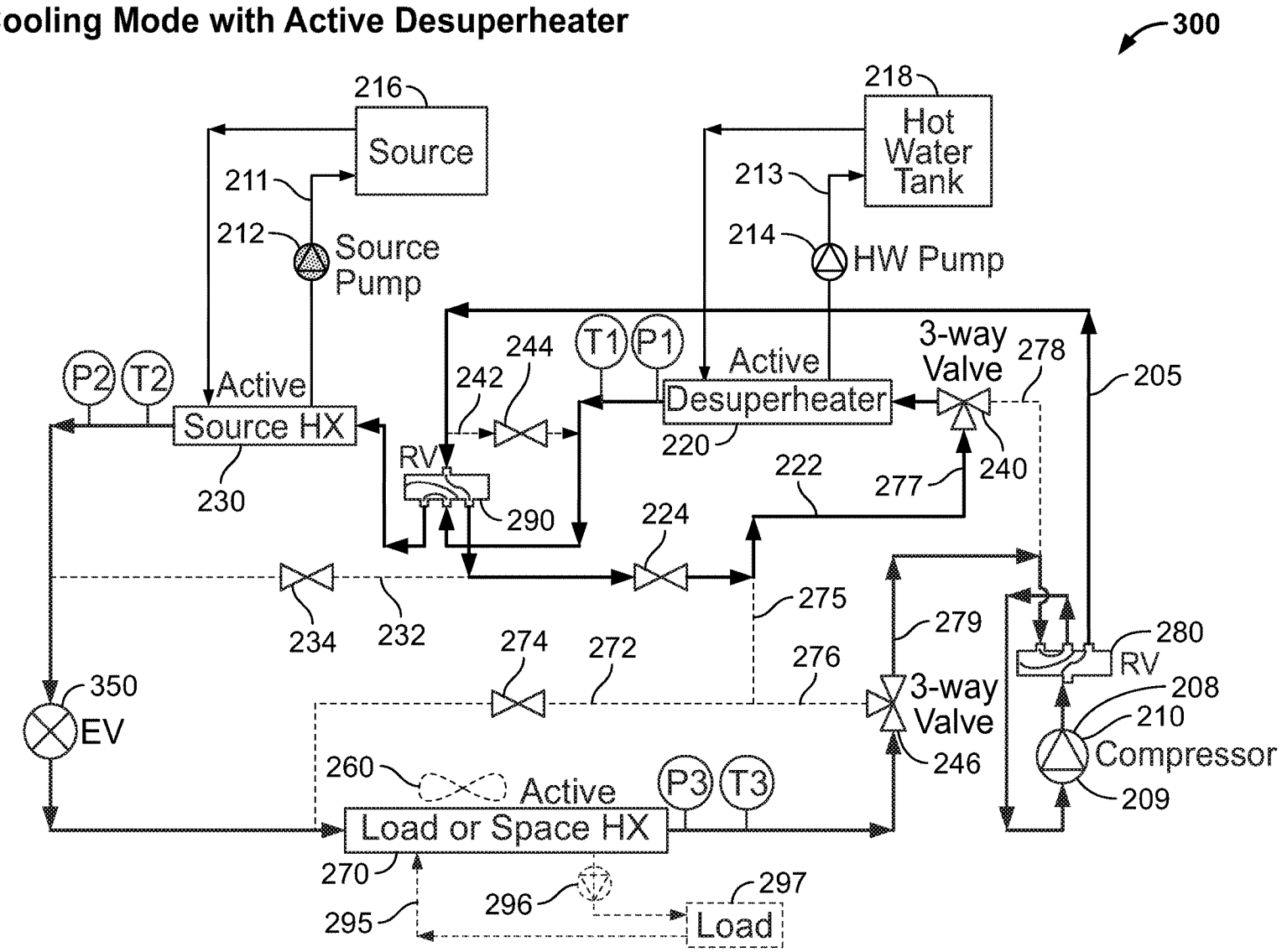
FIG. 14 is a schematic showing the HVAC system of FIG. 13 in a cooling mode with an active desuperheater.
Figure 15:
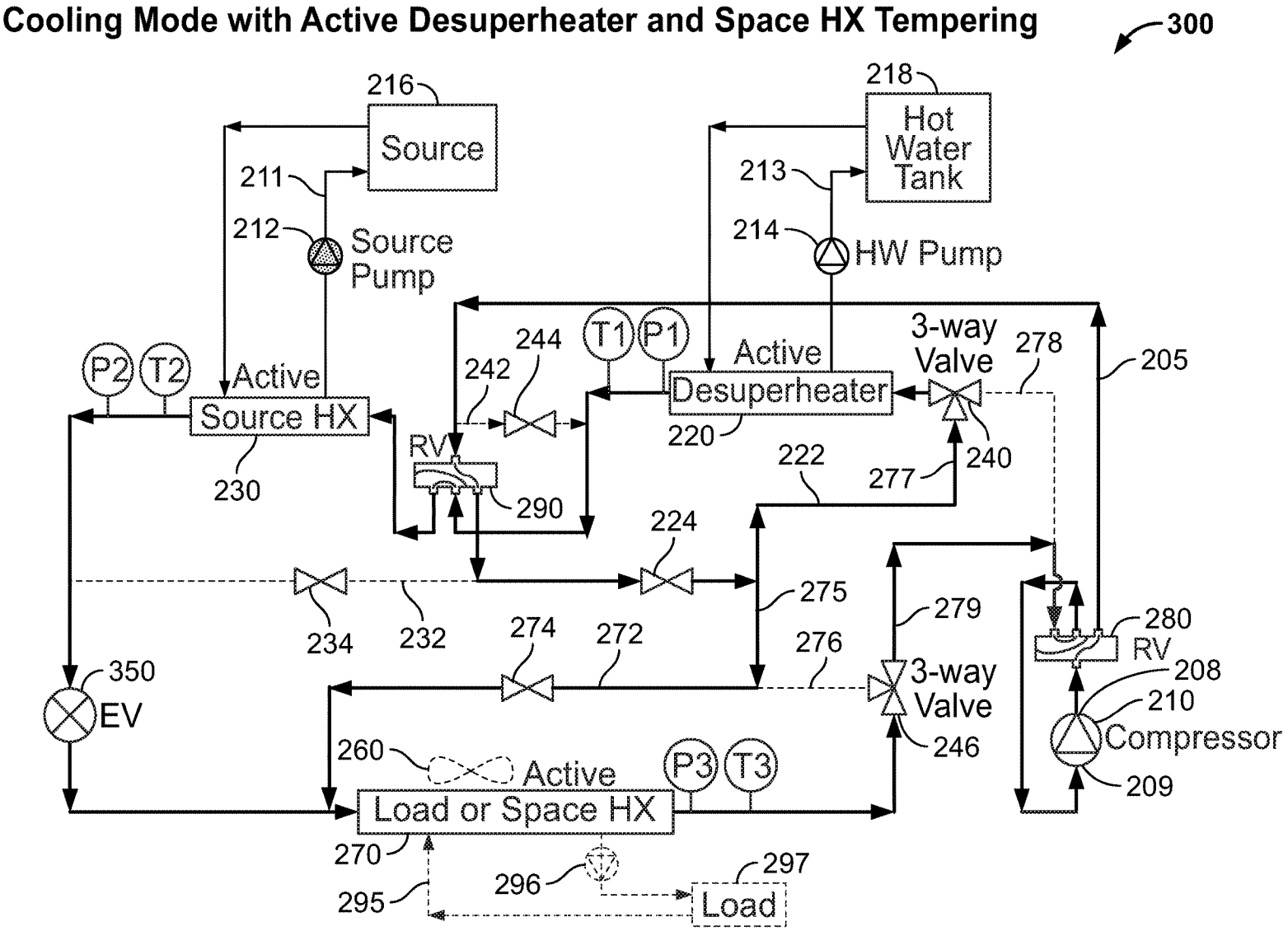
FIG. 15 is a schematic showing the HVAC system of FIG. 13 in a cooling mode with an active desuperheater and space heat exchanger tempering.
Figure 16:
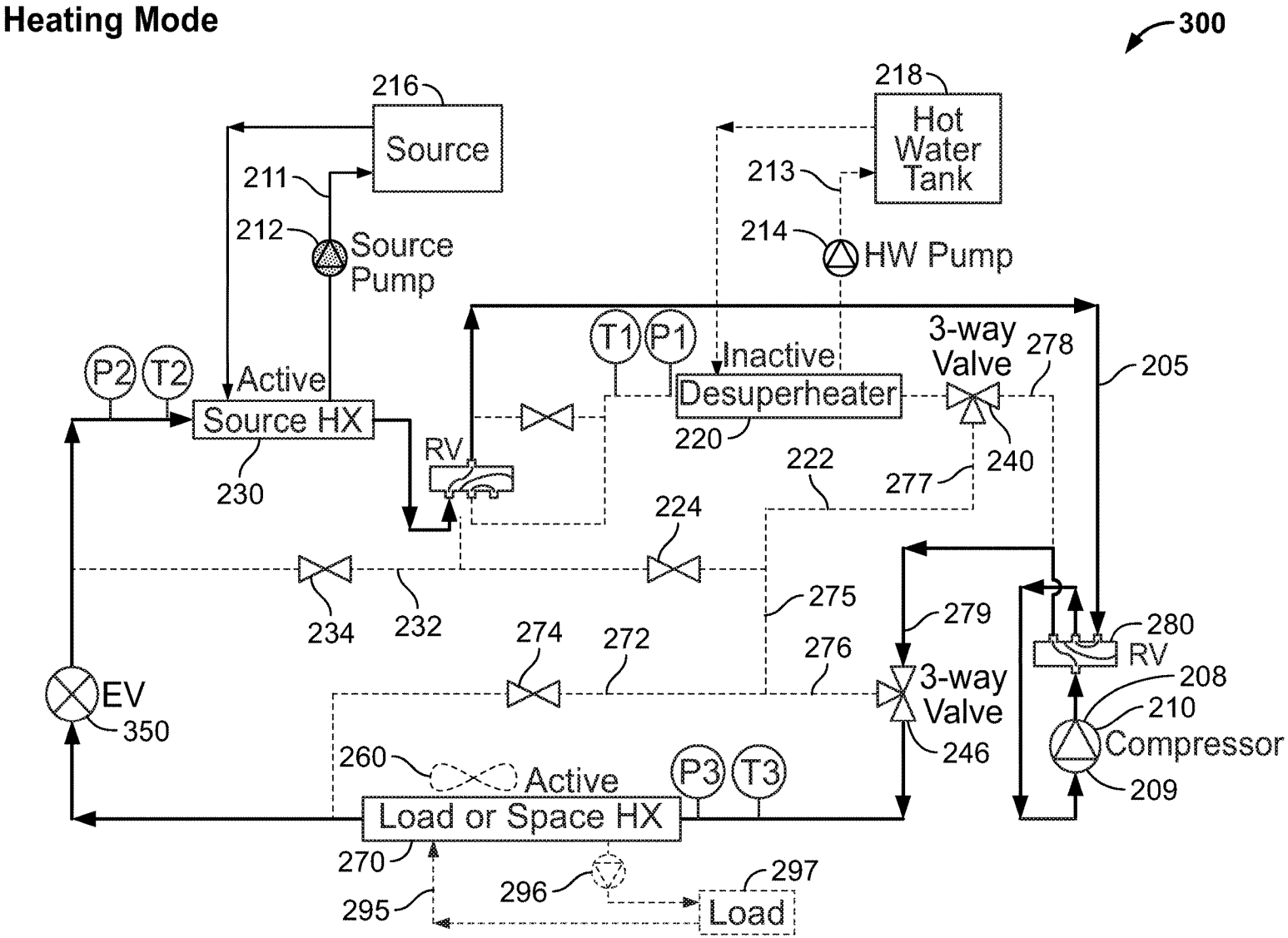
FIG. 16 is a schematic showing the HVAC system of FIG. 13 in a heating mode.
Figure 17:
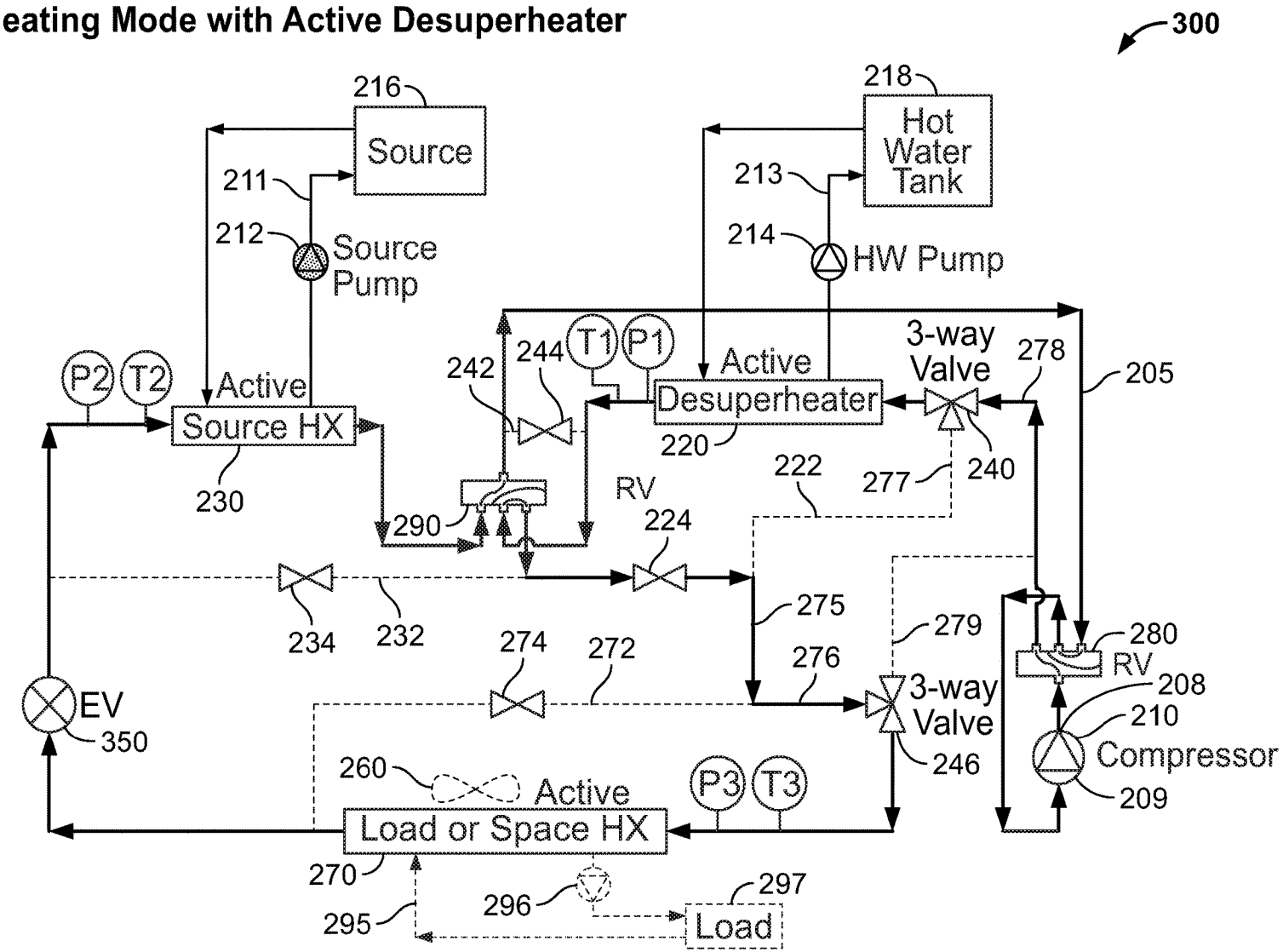
FIG. 17 is a schematic showing the HVAC system of FIG. 13 in a heating mode with an active desuperheater.
Figure 18:
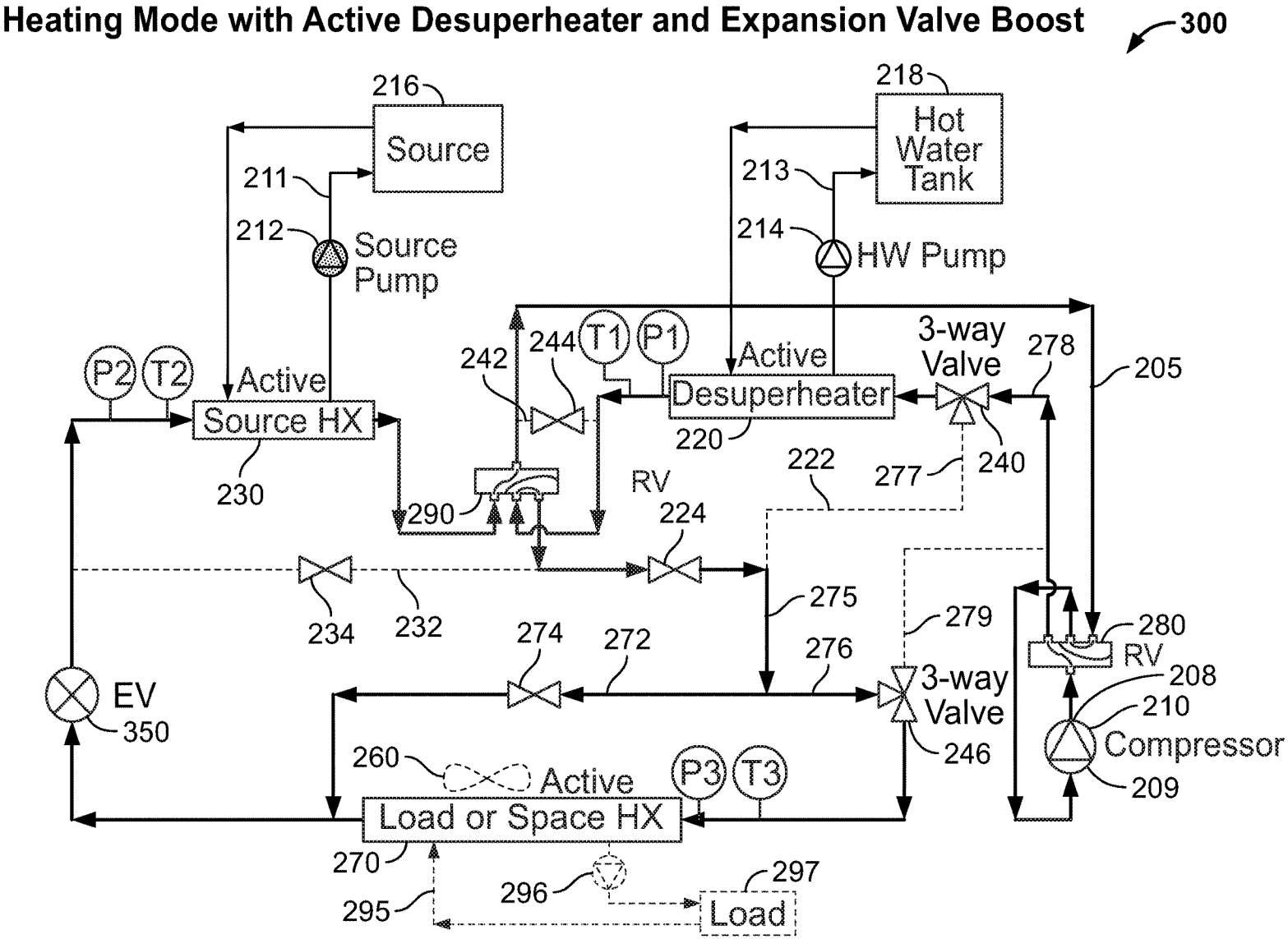
FIG. 18 is a schematic showing the HVAC system of FIG. 13 in a heating mode with an active desuperheater and expansion valve boost.

Turning now to FIGS. 13-18, there are shown various operating modes of HVAC system 300 configured to condition air in a space and optionally to heat water for domestic, commercial, or industrial process uses. FIG. 13 shows HVAC system 300 configured to operate in a cooling mode. FIG. 14 shows HVAC system 300 configured to operate in a cooling mode with an active desuperheater. FIG. 15 shows HVAC system 300 configured to operate in a cooling mode with an active desuperheater and space heat exchanger tempering. FIG. 16 shows HVAC system 300 configured to operate in a heating mode. FIG. 17 shows HVAC system 300 configured to operate in a heating mode with an active desuperheater. FIG. 18 shows HVAC system 300 configured to operate in a heating mode with an active desuperheater and expansion valve boost.

In the embodiment of FIGS. 13-18, HVAC system 300 includes all of the same components, arrangement, features, and functionality as shown in the embodiment of FIGS. 7-12 except that the pair of expansion valves 250,254, expansion valve bypass circuits 251,255, and check valves 252,256 have been replaced with a single, bi-directional, mechanical or electronic expansion valve 350 positioned between source heat exchanger 230 and load or space heat exchanger 270.

Referring to FIG. 13, HVAC system 300 is shown in a cooling mode with desuperheater heat exchanger 220 inactive. In this mode: (i) all ports of 3-way valve 240 are closed to prohibit refrigerant flow through desuperheater heat exchanger 220 and to urge refrigerant leaving 3-way valve 246 to flow to reversing valve 280, (ii) bi-directional valve 274 of bypass circuit 272 is closed to prohibit refrigerant flow through bypass circuit 272, (iii) bi-directional valve 224 of desuperheater loop 222 is closed to prohibit refrigerant flow through desuperheater loop 222, (iv) bi-directional valves 234,244 are closed to prohibit refrigerant flow through bypass circuits 232,242 and (v) the port of 3-way valve 246 that is connected to conduit 276 is closed to prohibit refrigerant flow to bypass circuit 272 and to desuperheater loop 222. Compressed gaseous refrigerant exiting the compressor 210 at discharge outlet port 208 is conveyed to reversing valve 280, which directs the refrigerant to reversing valve 290, where the refrigerant is then conveyed to the source heat exchanger 230 acting as a condenser to exchange heat with the source fluid being conveyed through the source loop 211. The refrigerant leaving the source heat exchanger 230 is then conveyed to expansion valve 350. The refrigerant leaving expansion valve 350 is then conveyed to load or space heat exchanger 270 acting as an evaporator, which then conveys the refrigerant to the 3-way valve 246, which routes the refrigerant to reversing valve 280, which routes the refrigerant to the suction inlet port 209 of the compressor 210 to continue the cycle. Referring to FIG. 14, HVAC system 300 is shown in a cooling mode with an active desuperheater heat exchanger 220. In this mode: (i) two desuperheater ports of 3-way valve 240 are open to allow refrigerant flow through desuperheater heat exchanger 220 while the port of 3-way valve 240 connected to conduit 278 is closed to prohibit refrigerant flow to reversing valve 280 and to urge refrigerant leaving 3-way valve 246 to be directed to reversing valve 280, (ii) bi-directional valve 274 of bypass circuit 272 is closed to prohibit refrigerant flow through bypass circuit 272, (iii) bi-directional valve 224 of desuperheater loop 222 is open to allow refrigerant flow through desuperheater heat exchanger 220, (iv) bi-directional valves 234,244 are closed to prohibit refrigerant flow through bypass circuits 232,242, and (v) acting in concert with the closed bi-directional valve 274, the port of 3-way valve 246 that is connected to conduit 276 is closed to prohibit refrigerant flow through bypass circuit 272 and to 3-way valve 246. Compressed gaseous refrigerant exiting the compressor 210 at discharge outlet port 208 of refrigerant circuit 205 is conveyed to reversing valve 280, which directs the refrigerant to reversing valve 290, which conveys the refrigerant to open bi-directional valve 224, which conveys the refrigerant to 3-way valve 240, which conveys the refrigerant to desuperheater heat exchanger 220 to exchange heat with the water being conveyed through the hot water loop 213. Refrigerant leaving the desuperheater heat exchanger 220 is conveyed through reversing valve 290, then to the source heat exchanger 230 acting as a condenser to exchange heat with the source fluid being conveyed through the source loop 211. The refrigerant leaving the source heat exchanger 230 is conveyed to expansion valve 350. The refrigerant leaving expansion valve 350 is then conveyed to load or space heat exchanger 270 acting as an evaporator, which then conveys the refrigerant to the 3-way valve 246, which routes the refrigerant to reversing valve 280, which routes the refrigerant to the suction inlet port 209 of the compressor 210 to continue the cycle.

Referring to FIG. 15, HVAC system 300 is shown in a cooling mode with an active desuperheater heat exchanger 220 and load or space heat exchanger 270 tempering. In this mode: (i) two desuperheater ports of 3-way valve 240 are open to allow refrigerant flow through desuperheater heat exchanger 220 while the port of 3-way valve 240 connected to conduit 278 is closed to prohibit refrigerant flow to reversing valve 280 and to urge refrigerant leaving 3-way valve 246 to be directed to reversing valve 280, (ii) bi-directional valve 274 of bypass circuit 272 is open to allow refrigerant flow through bypass circuit 272, (iii) bi-directional valve 224 of desuperheater loop 222 is open to allow refrigerant flow through desuperheater heat exchanger 220 and through bypass circuit 272, (iv) bi-directional valves 234,244 are closed to prohibit refrigerant flow through bypass circuits 232,242, and (v) the port of 3-way valve 246 that is connected to conduit 276 is closed to urge refrigerant to flow through bypass circuit 272 and not to 3-way valve 246. Compressed gaseous refrigerant exiting the compressor 210 at discharge outlet port 208 of refrigerant circuit 205 is conveyed to reversing valve 280, which directs the refrigerant to reversing valve 290, which conveys the refrigerant to open bi-directional valve 224, which conveys a first portion of the refrigerant to 3-way valve 240, which conveys the refrigerant to desuperheater heat exchanger 220 to exchange heat with the water being conveyed through the hot water loop 213. Refrigerant leaving the desuperheater heat exchanger 220 is conveyed through reversing valve 290, then to the source heat exchanger 230 acting as a condenser to exchange heat with the source fluid being conveyed through the source loop 211. The refrigerant leaving the source heat exchanger 230 is conveyed to expansion valve 350. In addition, a second portion of the refrigerant leaving bi-directional valve 224 is conveyed to bypass circuit 272 through open bi-directional valve 274 and is brought together with the first portion of the refrigerant leaving the expansion valve 350 and conveyed to load or space heat exchanger 270 acting as an evaporator. Refrigerant leaving load or space heat exchanger 270 is conveyed to 3-way valve 246, which routes the refrigerant to reversing valve 280, which routes the refrigerant to the suction inlet port 209 of the compressor 210 to continue the cycle. The controller 285 may be configured to control the opening of, and therefore the amount and/or rate of refrigerant passing through, bi-directional valve 274 and/or 3-way valve 240 to control the amount of the refrigerant being conveyed through bypass circuit 272 that is mixed with the refrigerant exiting expansion valve 350 to control heat exchange occurring in load or space heat exchanger 270.

Referring to FIG. 16, HVAC system 300 is shown in a heating mode with desuperheater heat exchanger 220 inactive. In this mode: (i) all ports of 3-way valve 240 are closed to prohibit refrigerant flow through desuperheater heat exchanger 220 and to urge compressed gaseous refrigerant leaving reversing valve 280 to flow to 3-way valve 246, (ii) bi-directional valve 274 of bypass circuit 272 is closed to prohibit refrigerant flow through bypass circuit 272, (iii) bi-directional valve 224 of desuperheater loop 222 is closed to prohibit refrigerant flow to reversing valve 290, (iv) bi-directional valves 234,244 are closed to prohibit refrigerant flow through bypass circuits 232,242 and (v) the port of 3-way valve 246 that is connected to conduit 276 is closed to prohibit refrigerant flow from 3-way valve 246 to bypass circuit 272 and to desuperheater loop 222. Compressed gaseous refrigerant exiting the compressor 210 at discharge outlet port 208 of refrigerant circuit 205 is conveyed to 3-way valve 246, which conveys the refrigerant to load or space heat exchanger 270 acting as an evaporator. Refrigerant leaving the load or space heat exchanger 270 is convey to expansion valve 350. The refrigerant leaving expansion valve 350 is then conveyed to source heat exchanger 230 acting as a evaporator to exchange heat with the source fluid being conveyed through the source loop 211. The refrigerant leaving source heat exchanger 230 is conveyed to reversing valve 290, which directs the refrigerant to reversing valve 280, which directs the refrigerant to suction inlet port 209 of compressor 210 to continue the cycle.

Referring to FIG. 17, HVAC system 300 is shown in a heating mode with an active desuperheater heat exchanger 220. In this mode: (i) two desuperheater ports of 3-way valve 240 are open to allow refrigerant flow through desuperheater heat exchanger 220 while the port of 3-way valve 240 connected to conduit 277 is closed to prohibit refrigerant flow to conduit 277 and to urge refrigerant leaving bi-directional valve 224 to be directed to conduits 275,276, which convey the refrigerant to 3-way valve 246, (ii) bi-directional valve 274 of bypass circuit 272 is closed to prohibit refrigerant flow through bypass circuit 272, (iii) bi-directional valve 224 is open to allow refrigerant to flow to conduits 275,276, which convey the refrigerant to 3-way valve 246, (iv) bi-directional valves 234,244 are closed to prohibit refrigerant flow through bypass circuits 232,242, and (v) the port of 3-way valve 246 that is connected to conduit 276 is open to allow refrigerant to be conveyed by conduits 275,276 to 3-way valve 246 while the port of 3-way valve 246 that is connected to conduit 279 is closed to prohibit refrigerant from flowing to or from reversing valve 280. Compressed gaseous refrigerant exiting the compressor 210 at discharge outlet port 208 of refrigerant circuit 205 is conveyed to 3-way valve 240, which conveys the refrigerant to desuperheater heat exchanger 220 to exchange heat with the water being conveyed through the hot water loop 213. Refrigerant leaving the desuperheater heat exchanger 220 is conveyed through reversing valve 290, which routes the refrigerant through open bi-directional valve 224. The refrigerant is then conveyed by conduits 275,276 to 3-way valve 246, which conveys the refrigerant to load or space heat exchanger 270 acting as an evaporator. Refrigerant leaving the load or space heat exchanger 270 is conveyed to expansion valve 350. The refrigerant leaving expansion valve 350 is then conveyed to source heat exchanger 230 acting as a evaporator to exchange heat with the source fluid being conveyed through the source loop 211. The refrigerant leaving source heat exchanger 230 is conveyed to reversing valve 290, which directs the refrigerant to reversing valve 280, which directs the refrigerant to suction inlet port 209 of compressor 210 to continue the cycle.

Referring to FIG. 18, HVAC system 300 is shown in a heating mode with an active desuperheater heat exchanger 220 and expansion valve boost for ensuring that expansion valve 350 will control the system properly and to avoid flashing of refrigerant prior to entry into the source heat exchanger 230. In this mode: (i) two desuperheater ports of 3-way valve 240 are open to allow refrigerant flow through desuperheater heat exchanger 220 while the port of 3-way valve 240 connected to conduit 277 is closed to prohibit refrigerant flow to conduit 277 and to urge refrigerant leaving bi-directional valve 224 to be directed to conduit 275, (ii) bi-directional valve 274 of bypass circuit 272 is open to cause a portion of the refrigerant to bypass the load or space heat exchanger 270 to provide boost to expansion valve 350, (iii) bi-directional valve 224 is open to allow refrigerant to flow to conduit 275 and then to bi-directional valve 274 and to 3-way valve 246, (iv) bi-directional valves 234,244 are closed to prohibit refrigerant flow through bypass circuits 232,242, and (v) the port of 3-way valve 246 that is connected to conduit 276 is open to allow refrigerant to be conveyed by conduits 275,276 to 3-way valve 246 while the port of 3-way valve 246 that is connected to conduit 279 is closed to prohibit refrigerant from flowing to or from reversing valve 280. Compressed gaseous refrigerant exiting the compressor 210 at discharge outlet port 208 of refrigerant circuit 205 is conveyed to 3-way valve 240, which conveys the refrigerant to desuperheater heat exchanger 220 to exchange heat with the water being conveyed through the hot water loop 213. Refrigerant leaving the desuperheater heat exchanger 220 is conveyed through reversing valve 290, which routes the refrigerant through open bi-directional valve 224. The controller 285 may be configured to control the opening of, and therefore the amount and/or rate of refrigerant passing through, bi-directional valve 274 and/or 3-way valve 246 to control the amount of the refrigerant being conveyed through bypass circuit 272 that is mixed with the refrigerant exiting load or space heat exchanger 270 to provide a boost to the inlet conditions of the refrigerant entering expansion valve 254. Consequently, upon leaving the bi-directional valve 224, a first portion of the refrigerant is conveyed to the 3-way valve 246 and a second portion of the refrigerant is conveyed to open bi-directional valve 274 where the amount of the first and second portions is determined by the orifice sizes commanded by controller 285 in the respective 3-way valve 246 and bi-directional valve 274. The first portion of the refrigerant leaving the 3-way valve is conveyed to load or space heat exchanger 270 acting as an evaporator while the second portion of the refrigerant leaving bi-directional valve 274 of bypass circuit 272 bypasses the load or space heat exchanger 270 and is mixed with the first portion of the refrigerant leaving the load or space heat exchanger 270. All of the refrigerant is then conveyed to expansion valve 350. The refrigerant leaving expansion valve 350 is then conveyed to source heat exchanger 230 acting as a evaporator to exchange heat with the source fluid being conveyed through the source loop 211. The refrigerant leaving source heat exchanger 230 is conveyed to reversing valve 290, which directs the refrigerant to reversing valve 280, which directs the refrigerant to suction inlet port 209 of compressor 210 to continue the cycle.

With respect to any of the foregoing operating modes shown in FIGS. 7-12 and 13-18, the controller 285 may monitor temperature and pressure data reported to it from temperature sensors T1, T2 and T3 and from pressure sensors P1, P2 and P3, as applicable according to the respective operating mode, to determine if the refrigerant is expanding, condensing or in a steady state. With this information, the controller 285 may adjust, as needed, the opening of any port of any of the 3-way valves 240,246, the opening of any of the bi-directional valves 224,274, 234, 244, the opening of the expansion valves 250,254, the configuration of the first and second reversing valves 280, 290, the speed of the compressor 210, the speed of the source fluid pump 212, the speed of the hot water pump 214, and the speed of the fan 260 to adjust the refrigerant mass flow and quality and to optimize the efficiency of the refrigeration cycle. In addition, a fewer or greater number of temperature and pressure sensors may be utilized and positioned at different locations than what is shown in the figures. For example, temperature and/or pressure sensors may be positioned at both the inlet and the discharge locations of any heat exchanger in the system. In addition, temperature sensors and flow sensors may be positioned along one or both of the source loop 211 and the hot water loop 213.

To switch from a cooling or heating mode with an active desuperheater shown in FIGS. 8-9, 11-12, 14-15, and 17-18 to another mode, the controller 285 of HVAC system 200, 300 is configured to throttle open and closed bi-directional valve 244. Doing so allows refrigerant to flow through bypass circuit 242 to provide adequate back pressure for reversing valve 290 to reverse the direction of refrigerant in refrigerant circuit 205 as required by the new operating mode called for by the system or a user.

In any of the operating modes shown in FIGS. 8-12 and 14-18 with an active desuperheater heat exchanger 220, when valve 234 is commanded open by controller 285, at least some refrigerant will bypass the source heat exchanger 230 and enter expansion valve 254 (FIGS. 8-9), expansion valve 250 (FIGS. 11-12), or expansion valve 350 (FIGS. 14-15 and 17-18) to control and/or eliminate partial condensation of refrigerant in the desuperheater heat exchanger 220.

Refrigerant circuits 105,205 include one or more conduits through which refrigerant flows and which fluidly connects the components of HVAC systems 100,200,300 to one another. The one or more conduits are arranged in a manner that provides highest temperature compressor discharge gas to a desuperheater when active to maximize heating efficiency by desuperheater heat exchangers 120,220 of water circulated through hot water loops 113,213. Compressors 110,210 may each be a variable capacity compressor, such as a variable speed compressor, a compressor with an integral pulse-width modulation option, or a compressor incorporating various unloading options. These types of compressors allow for better control of the operating conditions and management of the thermal load on the refrigerant circuits 105,205.

Controller 185,285 may include a processor 186,286 coupled to memory 187,287 on which one or more software algorithms are stored to process and issue commands to open, partially open, or close any of the valves disclosed herein. Open or closed feedback loops may be employed to determine current and desired valve positions.

Any of the check valves 252,256, bi-directional valves 134,124,174,224,234,244,274, 3-way valves 140,240,246, expansion valves 150,250,254,350 may be automatically cycled open and closed and/or controlled on and off with a PWM signal to modulate the amount of refrigerant flowing therethrough.

Expansion valves 150,250,254,350 may each be an electronic expansion valve, a mechanical expansion valve, a fixed-orifice/capillary tube/accurator, or any combination of the these. These valves may have bi-directional functionality or may be replaced by a pair of uni-directional expansion devices coupled with the associated bypass check valves as described above to provide refrigerant rerouting when the flow changes direction throughout the refrigerant cycle between cooling and heating modes of operation.

While specific embodiments have been described in detail, it will be appreciated by those skilled in the art that various modifications and alternatives to those details could be developed in light of the overall teachings of the disclosure. Accordingly, the disclosure herein is meant to be illustrative only and not limiting as to its scope and should be given the full breadth of the appended claims and any equivalents thereof.

The invention claimed is:

1. An HVAC system for conditioning air in a space, comprising:

a refrigerant circuit that fluidly interconnects:

a compressor to circulate a refrigerant through the refrigerant circuit, the compressor having a discharge outlet port and an suction inlet port;

a source heat exchanger operable as either a condenser or an evaporator for exchanging heat with a source fluid;

a space heat exchanger operable as either a condenser or an evaporator for heating or cooling air in the space;

a desuperheater heat exchanger operable as a condenser for heating water;

a first reversing valve positioned downstream of the compressor to selectively direct the refrigerant from the discharge outlet port of the compressor to one of a second reversing valve, a first 3-way valve, and a second 3-way valve and to selectively return the refrigerant from one of the second reversing valve and the second 3-way valve to the suction inlet port of the compressor, wherein the first 3-way valve is configured to selectively direct the refrigerant to the desuperheater heat exchanger from one of the first and second reversing valves, and the second 3-way valve is configured to selectively direct the refrigerant to the first reversing valve and the space heat exchanger;

first and second expansion devices positioned between the source and space heat exchangers;

first and second expansion device bypass circuits configured to allow the refrigerant to bypass the first and second expansion devices, respectively, the first and second expansion device bypass circuits comprising first and second check valves, respectively, to control a direction of the refrigerant in the first and second expansion device bypass circuits; and a first bi-directional valve positioned downstream of the second reversing valve to selectively convey the refrigerant to at least one of the first 3-way valve, the second 3-way valve, and a second bi-directional valve, wherein the second bi-directional valve modulates exchange of heat in the space heat exchanger when the space heat exchanger is operating as an evaporator and eliminates flashing of the refrigerant entering the source heat exchanger when the source heat exchanger is operating as an evaporator.

2. The HVAC system of claim 1, wherein the compressor is a variable capacity compressor.

3. The HVAC system of claim 1, including a liquid pump associated with the source heat exchanger and the liquid pump is a variable capacity pump.

4. The HVAC system of claim 1, wherein the space heat exchanger is a refrigerant-to-air heat exchanger.

5. The HVAC system of claim 1, including a fan driven by a variable speed motor, the fan configured to flow air over a portion of the space heat exchanger.

6. The HVAC system of claim 1, wherein the first and second expansion devices are fixed orifice devices, mechanical valves, or electronic valves.

7. The HVAC system of claim 1, wherein the desuperheater heat exchanger is a refrigerant-to-liquid heat exchanger configured to exchange heat between the refrigerant in the refrigerant circuit and water in a storage loop.

8. The HVAC system of claim 7, including a storage tank for storing heated water.

9. The HVAC system of claim 7, including a variable speed water pump for circulating heated water in the storage loop and through the desuperheater heat exchanger.

10. The HVAC system of claim 7, wherein the source heat exchanger is a refrigerant-to-liquid heat exchanger configured to exchange heat between the refrigerant in the refrigerant circuit and the source fluid in a source loop.

11. The HVAC system of claim 10, including a variable speed source fluid pump for circulating the source fluid in the source loop and through the source heat exchanger.

12. The HVAC system of claim 7, including a third bi-directional valve positioned upstream of the second reversing valve to temporarily divert the refrigerant away from the second reversing valve when switching the second reversing valve from one operating configuration to another, and a fourth bi-directional valve positioned downstream of the second reversing valve to divert partially condensed refrigerant from the desuperheater heat exchanger to one of the first and second expansion devices.

13. The HVAC system of claim 1, including a controller comprising a processor and memory on which one or more software programs are stored, the controller configured to control operation of the compressor, the first and second reversing valves, the first and second 3-way valves, the first and second expansion devices, the first and second bi-directional valves, a first variable speed pump for circulating water through the desuperheater heat exchanger, and a second variable speed pump for circulating the source fluid through the source heat exchanger.

14. The HVAC system of claim 13, wherein in a space cooling mode, the first reversing valve diverts the refrigerant from the compressor to the second reversing valve and from the second 3-way valve to the compressor, the second reversing valve diverts the refrigerant from the first reversing valve to the source heat exchanger configured as a condenser, the first and second bi-directional valves are closed, the first expansion device is closed and the refrigerant is diverted through the first check valve via the first expansion device bypass circuit, the second expansion device is open and directs the refrigerant to the space heat exchanger configured as an evaporator, and the second 3-way valve diverts the refrigerant from the space heat exchanger to the first reversing valve.

15. The HVAC system of claim 13, wherein in a cooling mode with an active desuperheater, the first reversing valve diverts the refrigerant from the compressor to the second reversing valve and from the second 3-way valve to the compressor, the second reversing valve diverts the refrigerant from the first reversing valve to the first bi-directional valve and from the desuperheater heat exchanger to the source heat exchanger configured as a condenser, the first bi-directional valve is open, the second bi-directional valve is closed, the first expansion device is closed and the refrigerant is diverted through the first check valve via the first expansion device bypass circuit, the second expansion device is open and directs the refrigerant to the space heat exchanger configured as an evaporator, and the second 3-way valve diverts the refrigerant from the space heat exchanger to the first reversing valve.

16. The HVAC system of claim 13, wherein in a cooling mode with an active desuperheater and with space heat exchanger tempering, the first reversing valve diverts the refrigerant from the compressor to the second reversing valve and from the second 3-way valve to the compressor, the second reversing valve diverts the refrigerant from the first reversing valve to the first bi-directional valve and from the desuperheater heat exchanger to the source heat exchanger configured as a condenser, the first bi-directional valve and the second bi-directional valve are open and a first portion of the refrigerant from the first bi-directional valve is conveyed to the first 3-way valve and a second portion of the refrigerant is conveyed to the second bi-directional valve, wherein the first portion of the refrigerant is conveyed to the desuperheater heat exchanger and then to the source heat exchanger via the second reversing valve, the first expansion device is closed and the first portion of the refrigerant is conveyed from the source heat exchanger through the first check valve via the first expansion device bypass circuit and to the second expansion device, the second expansion device is open, and the first portion of the refrigerant from the second expansion device and the second portion of the refrigerant from the second bi-directional valve are mixed and conveyed to the space heat exchanger configured as an evaporator, and the second 3-way valve diverts the refrigerant from the space heat exchanger to the first reversing valve.

17. The HVAC system of claim 13, wherein in a space heating mode, the first reversing valve diverts the refrigerant from the compressor to the second 3-way valve and from the second reversing valve to the compressor, the second reversing valve diverts the refrigerant from the source heat exchanger configured as an evaporator to the first reversing valve, the second 3-way valve diverts the refrigerant to the space heat exchanger configured as a condenser, the first and second bi-directional valves are closed, the second expansion device is closed and the refrigerant is diverted through the second check valve via the second expansion device bypass circuit, the first expansion device is open and directs the refrigerant to the source heat exchanger configured as an evaporator, and the refrigerant leaving the source heat exchanger is directed to the second reversing valve.

18. The HVAC system of claim 13, wherein in a heating mode with an active desuperheater, the first reversing valve diverts the refrigerant from the compressor to the first 3-way valve and from the second reversing valve to the compressor, the first 3-way valve diverts the refrigerant from the first reversing valve to the desuperheater heat exchanger, and the refrigerant leaving the desuperheater heat exchanger is conveyed to the second reversing valve, the second reversing valve diverts the refrigerant from the desuperheater heat exchanger to the first bi-directional valve and from the source heat exchanger to the first reversing valve, the first bi-directional valve is open and the refrigerant from the first bi-directional valve is conveyed to the second 3-way valve, the second 3-way valve diverts the refrigerant to the space heat exchanger configured as a condenser, the second bi-directional valve is closed, the second expansion device is closed and the refrigerant is conveyed through the second check valve via the second expansion device bypass circuit, the first expansion device is open and directs the refrigerant to the source heat exchanger configured as an evaporator, and the refrigerant leaving the source heat exchanger is directed to the second reversing valve.

19. The HVAC system of claim 13, wherein in a space heating mode with an active desuperheater and expansion device boost, the first reversing valve diverts the refrigerant from the compressor to the first 3-way valve and from the second reversing valve to the compressor, the first 3-way valve diverts the refrigerant from the first reversing valve to the desuperheater heat exchanger, and the refrigerant leaving the desuperheater heat exchanger is conveyed to the second reversing valve, the second reversing valve diverts the refrigerant from the desuperheater heat exchanger to the first bi-directional valve and from the source heat exchanger to the first reversing valve, the first bi-directional valve and the second bi-directional valve are open and a first portion of the refrigerant from the first bi-directional valve is conveyed to the second 3-way valve and a second portion of the refrigerant is conveyed to the second bi-directional valve, the second 3-way valve diverts the first portion of the refrigerant to the space heat exchanger configured as a condenser, wherein the second portion of the refrigerant from the second bi-directional valve is mixed with the first portion of the refrigerant from the space heat exchanger configured as a condenser and conveyed through the second check valve via the second expansion device bypass circuit to the first expansion device, the first expansion device is open and directs the refrigerant to the source heat exchanger configured as an evaporator, and the refrigerant leaving the source heat exchanger is directed to the second reversing valve.

* * * * *